US006922925B2

(12) United States Patent
Watanabe et al.

(10) Patent No.: US 6,922,925 B2
(45) Date of Patent: Aug. 2, 2005

(54) CONSTRUCTION MACHINE

(75) Inventors: Osamu Watanabe, Tsuchiura (JP); Seiichiro Takeshita, Tsuchiura (JP); Takaharu Nishimura, Kusatsu (JP); Kazuyoshi Yamada, Tsukuba (JP); Makoto Sugaya, Narita (JP); Makoto Motozu, Rittou (JP); Naohiro Ishikawa, Kouga (JP); Shougo Kimura, Kouga (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 19 days.

(21) Appl. No.: 10/257,682

(22) PCT Filed: Nov. 29, 2001

(86) PCT No.: PCT/JP01/10440

§ 371 (c)(1),
(2), (4) Date: Oct. 15, 2002

(87) PCT Pub. No.: WO02/44479

PCT Pub. Date: Jun. 6, 2002

(65) Prior Publication Data

US 2003/0110669 A1 Jun. 19, 2003

(30) Foreign Application Priority Data

Dec. 1, 2000 (JP) ..... 2000-367437

(51) Int. Cl.[7] ..... E02F 3/00

(52) U.S. Cl. ..... 37/466; 123/41.49; 123/41.56; 123/41.62; 180/68.4; 180/68.1

(58) Field of Search ..... 180/68.4, 68.1; 37/466, 443; 172/776; 123/41.1, 41.48, 41.49, 41.51, 41.54, 41.56, 41.62

(56) References Cited

U.S. PATENT DOCUMENTS

| | | | | | |
|---|---|---|---|---|---|
| 3,978,938 | A | * | 9/1976 | Joscher et al. | 180/68.4 |
| 4,382,481 | A | * | 5/1983 | Moore | 180/68.1 |
| 4,862,981 | A | * | 9/1989 | Fujikawa et al. | 180/68.4 |
| 6,032,620 | A | * | 3/2000 | Tsukiana et al. | 123/41.48 |
| 6,192,839 | B1 | * | 2/2001 | Takeshita et al. | 123/41.49 |
| 6,302,066 | B1 | * | 10/2001 | Steinmann | 123/41.49 |
| 6,390,770 | B1 | * | 5/2002 | Takeshita | 415/119 |
| 6,408,831 | B1 | * | 6/2002 | Craig et al. | 123/542 |
| 6,427,798 | B1 | * | 8/2002 | Imashige | 180/309 |
| 6,435,144 | B1 | * | 8/2002 | Dicke et al. | 123/41.12 |
| 6,491,133 | B2 | * | 12/2002 | Yamada et al. | 181/200 |
| 6,601,324 | B2 | * | 8/2003 | Iwasa et al. | 37/347 |

FOREIGN PATENT DOCUMENTS

| | | | |
|---|---|---|---|
| JP | U 6-1725 | | 1/1994 |
| JP | A 7-83054 | | 3/1995 |
| JP | 9-156384 | * | 6/1997 |
| JP | A 11-229431 | | 8/1999 |
| JP | 2000-16062 | * | 1/2000 |
| JP | A 2000-170207 | | 6/2000 |
| JP | A 2000-234351 | | 8/2000 |
| JP | A 2000-303496 | | 10/2000 |
| JP | 2002-356115 | * | 12/2002 |
| JP | 2003-155932 | * | 5/2003 |

* cited by examiner

*Primary Examiner*—Victor Batson
(74) *Attorney, Agent, or Firm*—Oliff & Berridge, PLC

(57) ABSTRACT

A construction machine of the present invention is provided, in a compartment formed by a cover, with an engine, a centrifugal fan, and a heat exchanger for exchanging heat between cooling air blown by the centrifugal fan and a specified medium, wherein the centrifugal fan and the heat exchanger are arranged further upstream than the engine with respect to flow of cooling air, so that cooling air sucked in by the centrifugal fan is led to the engine after passing through the heat exchanger.

17 Claims, 18 Drawing Sheets

CONSTRUCTION MACHINE

BACKGROUND OF THE INVENTION

1. Field of the Invention

The present invention relates to a construction machine having a cooling fan, a radiator, and an oil cooler etc.

2. Description of the Related Art

Generally, a swiveling type construction machine such as a hydraulic excavator is known as a construction machine. This hydraulic excavator is made up of a lower traveling body capable of self-propulsion, and an upper swiveling body mounted upon the undercarriage. A working unit capable of moving up and down for carrying out land excavation etc. is provided on the front of the upper swiveling body.

The upper swiveling body comprises a swiveling frame forming the structure body, an engine mounted on the swiveling frame, a hydraulic pump driven by the engine, a hydraulic oil tank for storing hydraulic oil mounted on the swiveling frame, heat exchangers such as a radiator for cooling engine coolant and an oil cooler for cooling the hydraulic oil, and a cooling fan for feeding cooling air towards the heat exchangers.

In recent years it has become usual for construction machines such as hydraulic excavators to carry out operations at construction sites within towns and streets etc., and there has been a demand for low noise operation. A hydraulic excavator using a sirocco fan (multi-blade fan) that runs comparatively silently as a cooling fan to meet this requirement is disclosed, for example, in Utility Model Laid-open No. Hei. 6-1725 and Japanese Patent Laid-open No. Hei. 7-83054. With the hydraulic excavators in these publications, cooling air that has been sucked in by the sirocco fan is blown out to heat exchangers such as a radiator and an oil cooler arranged above the sirocco fan, and heat is exchanged between the cooling air and the cooling water inside the radiator, and the hydraulic oil inside the oil cooler.

With the hydraulic excavators described in the above publications, cooling air taken into an engine compartment is led to the heat exchangers by way of the outside of the engine. Thus, cooling air of comparatively high-temperature passes through the heat exchanger, and this is not preferable from the point of view of cooling efficiency. In order to achieve a specified heat balance, if the cooling efficiency is low, the rotational speed of the cooling fan must be increased or the heat exchangers must be made larger in size. However, if the rotational speed of the cooling fan is increased, it becomes noisier. Also, if the heat exchangers are made larger, the rear end radius of a machine body becomes larger and operation at narrow and limited construction sites such as are found within towns and streets becomes difficult.

The hydraulic excavators of the above publications have the heat exchangers mounted at an upper side of the sirocco fan, therefore the sirocco fan and the motor etc. become located at a position below the heat exchangers and become hidden from view. As a result, when carrying out inspection and maintenance of the sirocco fan and motor, such as cleaning and repair operations, there is a problem of poor operability because it is difficult for an operator's hands to reach the sirocco fan and motor, as well as the difficulty for visual confirmation.

SUMMARY OF THE INVENTION

An object of the present invention is to provide a construction machine for obtaining improved cooling efficiency together with reduced noise.

In order to achieve the above described object, a construction machine of the present invention comprises, in a compartment formed by a cover, an engine, a centrifugal fan, and a heat exchanger for exchanging heat between cooling air blown by the centrifugal fan and a specified medium, wherein the centrifugal fan and the heat exchanger are arranged on the upstream side of the engine with respect to flow of cooling air, so that cooling air sucked in by the centrifugal fan is led toward the engine after passing through the heat exchanger.

In this way, together with being able to reduce noise, low temperature air is blown onto the heat exchanger and cooling efficiency is improved.

It is preferable that the intake side of the centrifugal fan is partitioned off from the exhaust side of the heat exchanger and the engine. Together with providing a driver's seat offset in the widthwise direction of the machine, it is possible to provide the engine behind the driver's seat and to arrange the centrifugal fan offset to the opposite side in the widthwise direction of the machine.

The centrifugal fan may be arranged above the heat exchanger with a duct for guiding cooling air from the centrifugal fan to the heat exchanger.

In this way, it is possible to simply carry out inspection operations and maintenance operations for the sirocco fan etc, and to improve operability.

It is preferable to arrange the centrifugal fan at an upper part of the compartment and to provide an intake port for cooling air at an upper part of the cover.

An axis of the centrifugal fan may be provided in a widthwise direction of the machine. In this case, it is preferable to locate an exhaust port for the cooling air below the engine.

It is possible to arrange the hydraulic pump driven by the engine and at least one of the hydraulic fluid reservoir controlling flow of hydraulic fluid from the hydraulic pump to an actuator, at a centrifugal fan side of the compartment. It is also possible to provide a duct for guiding cooling air from the centrifugal fan to the heat exchanger, and to arrange the duct adjacent to the hydraulic fluid reservoir.

It is acceptable to arrange the heat exchanger behind the driver's seat, and to arrange the engine to the side of the heat exchanger in a widthwise direction of the machine. In this case, it is preferable to arrange a rotation shaft of the centrifugal fan substantially in a horizontal direction and to arrange the heat exchanger above the centrifugal fan. Alternatively, the rotation shaft of the centrifugal fan may be arranged substantially in a vertical direction and the heat exchanger may be arranged to the side of the centrifugal fan.

It is also possible to arrange the heat exchanger substantially vertically with respect to the flow of cooling air blown from the centrifugal fan. The heat exchanger may comprise an oil cooler and a radiator, arrange the radiator in an outlet of a duct passage made of a duct, and arrange the oil cooler substantially vertically with respect to the duct passage at a specified location of a duct passage having a smaller passage area than the outlet of the duct passage.

It is also acceptable to provide a straightening vane directly downstream of the heat exchanger with respect to the flow of cooling air, and to change the flow of cooling air that has passed through the heat exchanger to a specified direction.

The present invention is preferably applied to a mini excavator.

DESCRIPTION OF THE PREFERRED EMBODIMENTS

A hydraulic excavator, particularly a mini excavator capable of small turns, will be described in detail in the following as an example of a construction machine of an embodiment of the present invention, with reference to the attached drawings. A mini excavator is a hydraulic excavator having a machine weight of, for example, less than 6 tons. In the following, as shown in the attached drawings, the longitudinal and lateral directions of the hydraulic excavator are defined, and arrangement of respective parts will be described based on this definition.

First Embodiment

A first embodiment of a construction machine of the present invention will now be described with reference to FIG. 1–FIG. 6.

The hydraulic excavator of this embodiment has a lower traveling body 1 and an upper swiveling body 2 mounted on the undercarriage 1 so as to be capable of swiveling, and a boom 3 for carrying out excavation is provided at a front side of the upper swiveling body 2.

Figure 1:
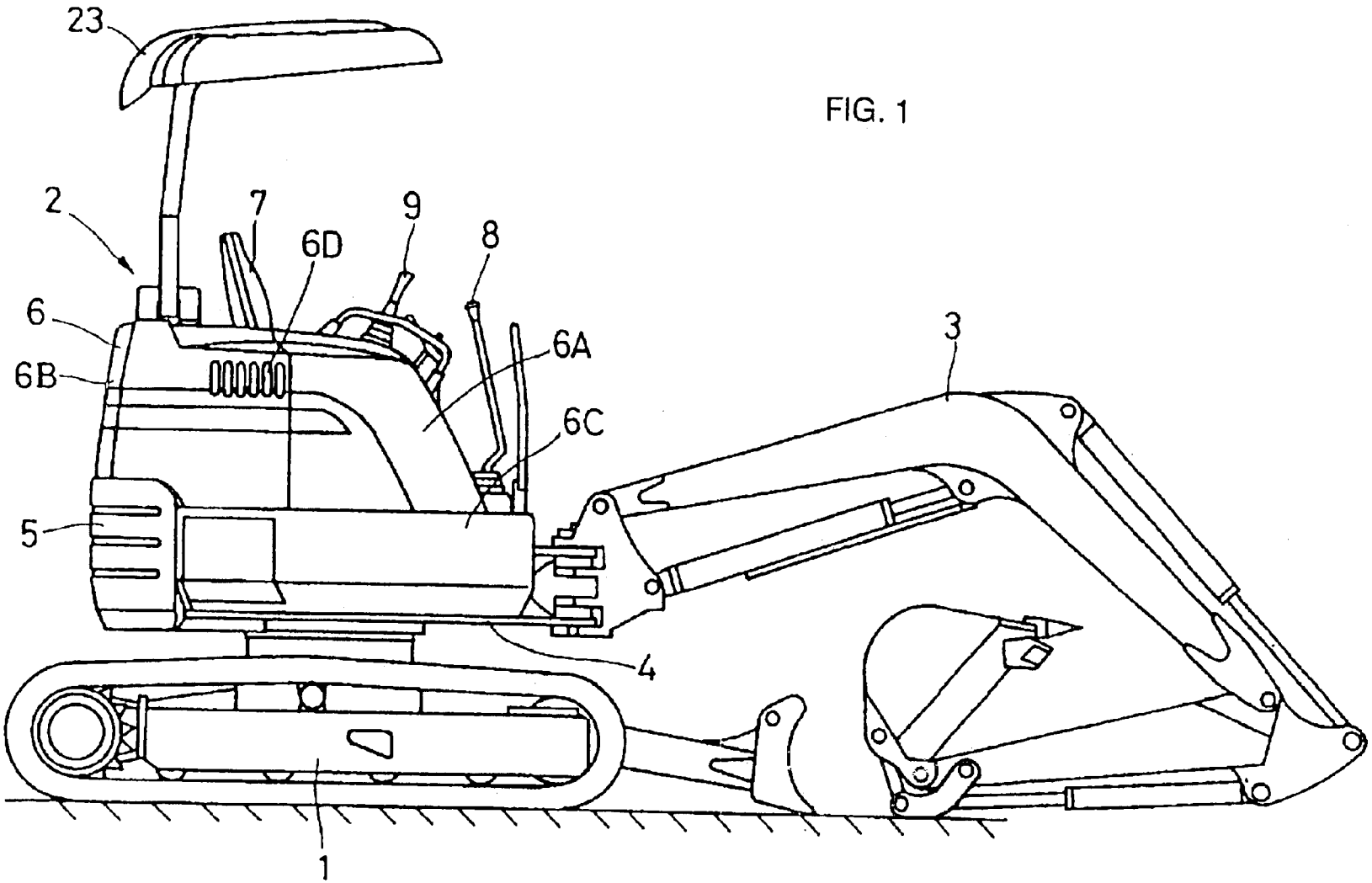
FIG. 1 is a front elevation of a hydraulic excavator to which a first embodiment of the present invention is applied.
Figure 2:
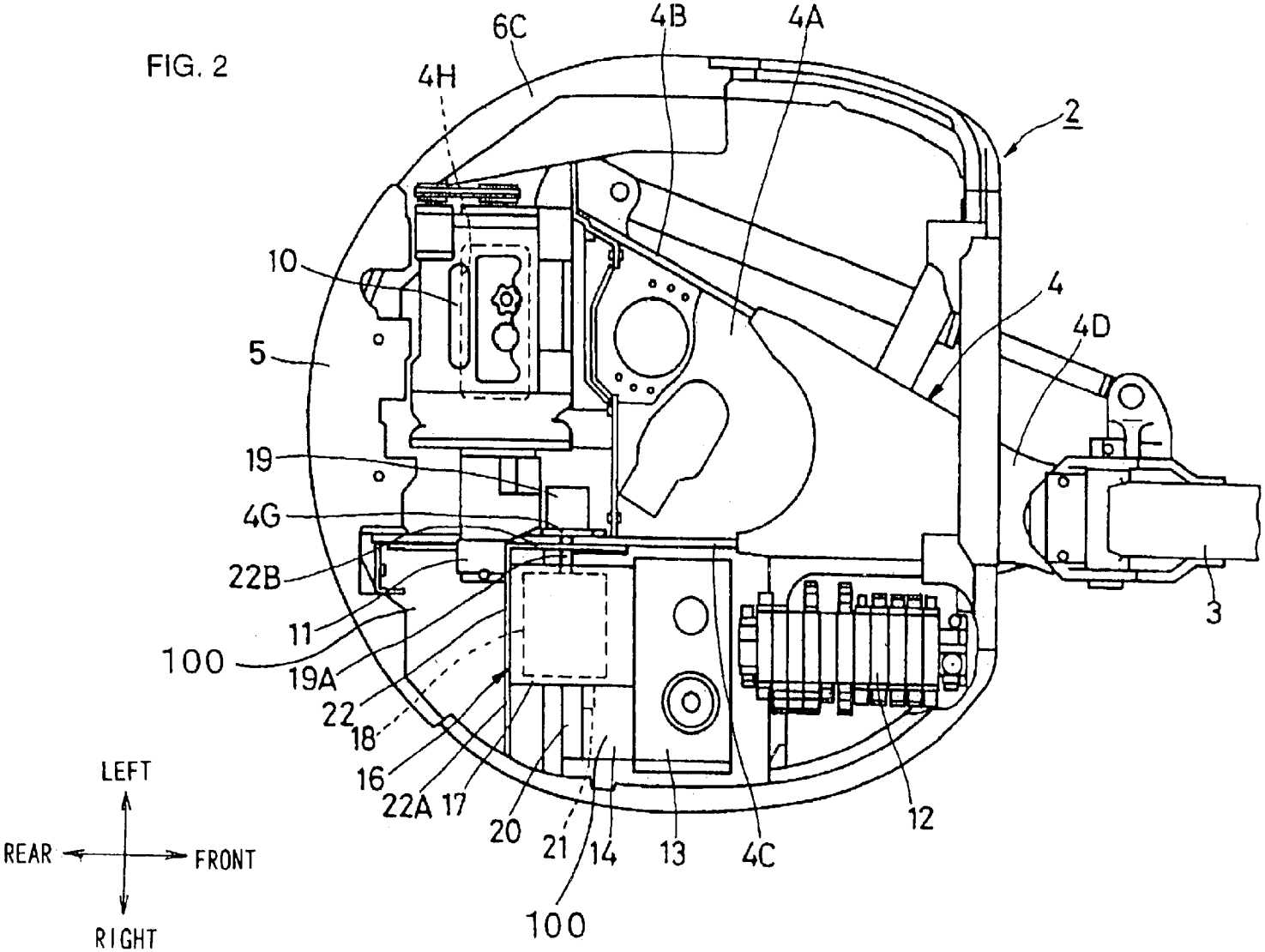
FIG. 2 is a plan view showing the appearance of an upper swiveling body with an external cover and driver's seat etc. removed.

As shown in FIG. 1 and FIG. 2, the upper swiveling body 2 mainly comprises a swiveling frame 4, which will be described later, a driver's seat 7, an engine 10, a hydraulic pump 11, a control valve unit 12, a hydraulic fluid reservoir 13, a cooling air duct 14, a sirocco fan 16, a radiator 20 and an oil cooler 21, etc. The upper swiveling body 2 has a substantially circular shape overall when viewed from above.

Figure 3:
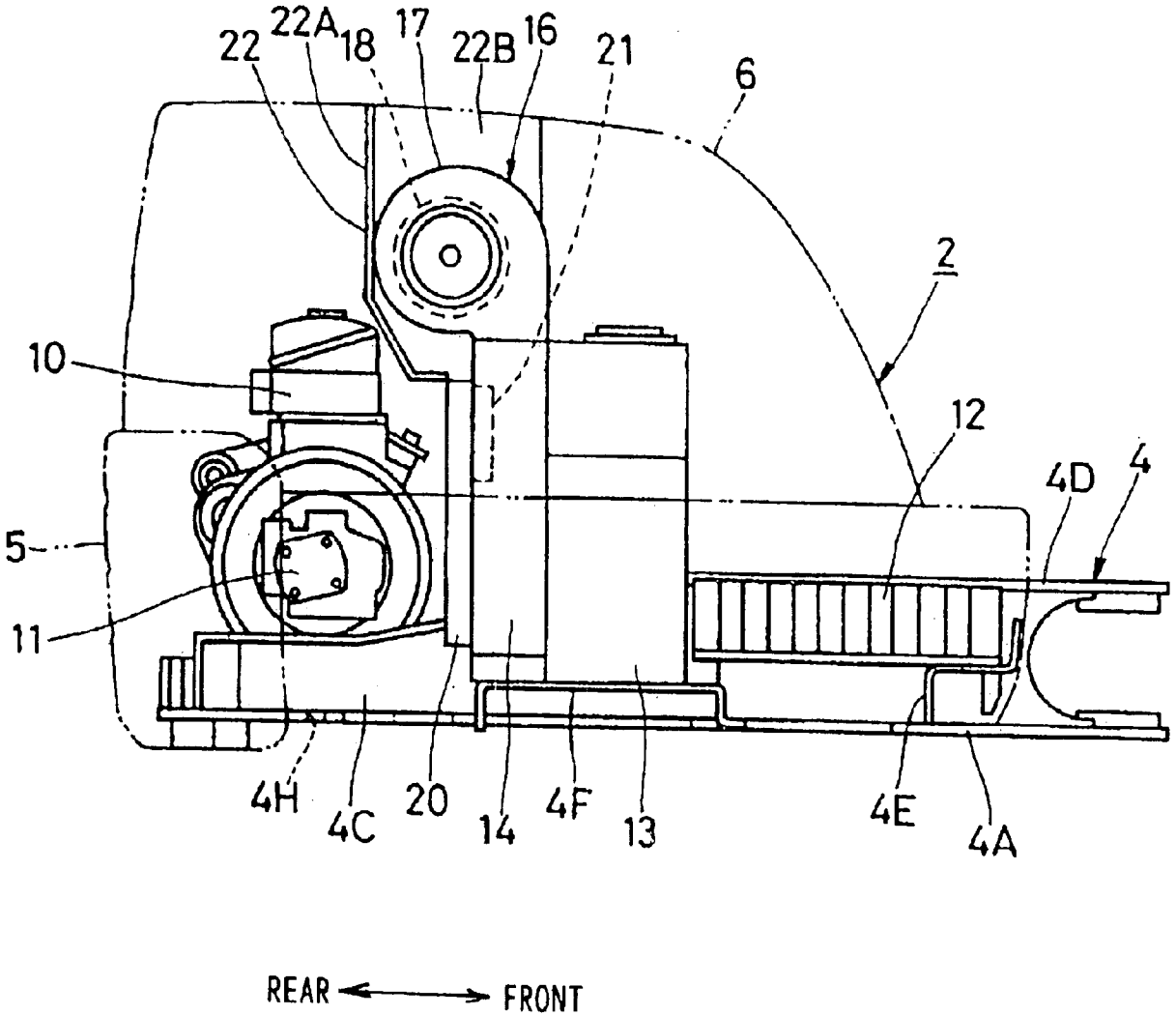
FIG. 3 is a front elevation view showing the appearance of the upper swiveling body with a counter weight, the external cover and the driver's seat etc. removed.
Figure 4:
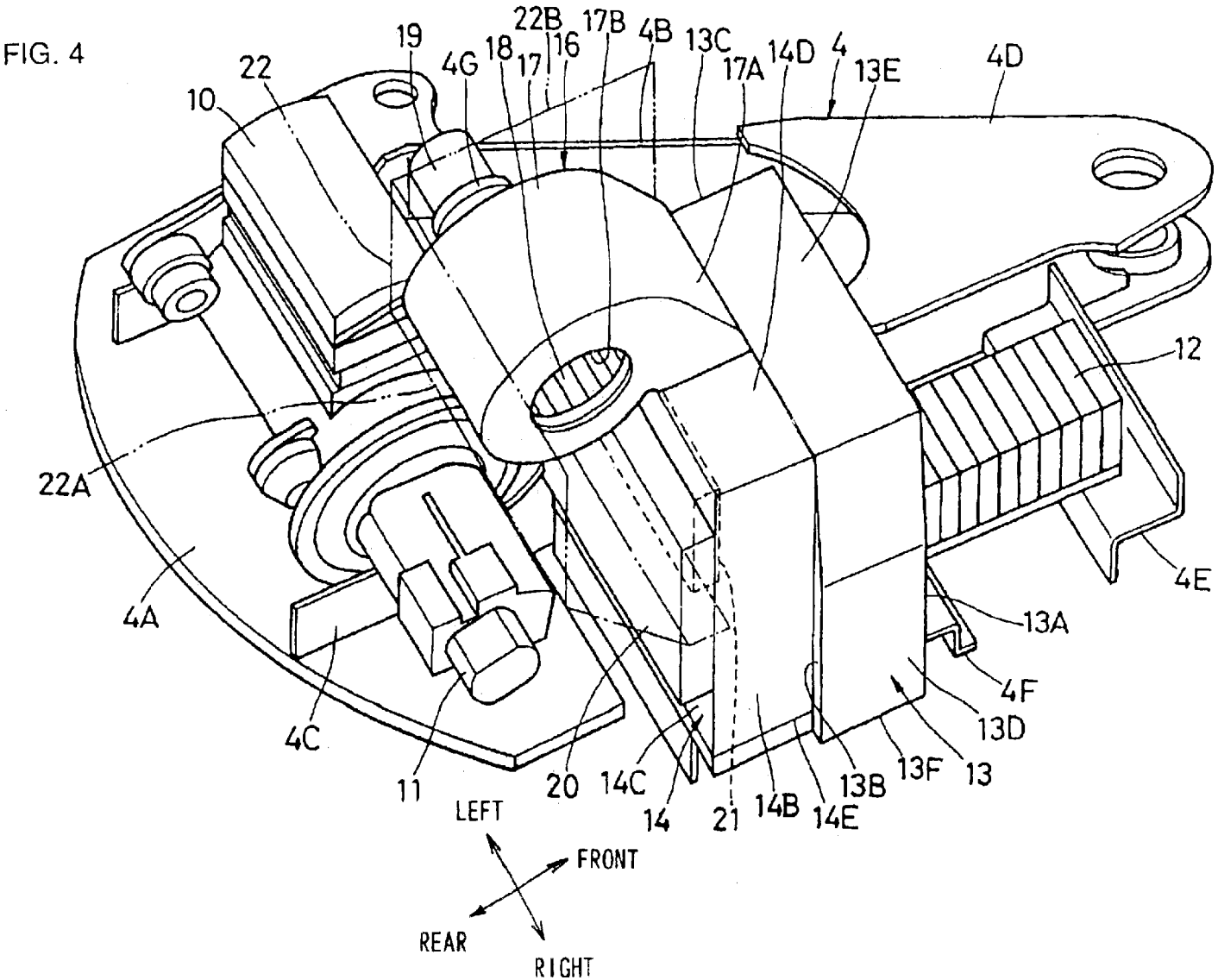
FIG. 4 is a perspective view showing an enlargement of the appearance of the upper swiveling body with a counter weight, the external cover and the driver's seat etc. removed.

As shown in FIG. 3 and FIG. 4, the swiveling frame 4 constituting a support structure for the turntable section 2 is mainly made up of a flat plate-shaped base plate 4A extending to the front and rear, a left erected plate 4B erected to the left side of the base plate 4A and inclined to the right side as extending from the rear to the front, a right erected plate 4C erected to the right side of the base plate 4A, extending to the front and rear, and an upper plate 4D fixed to front upper sides of each of the erected plates 4B and 4C. A boom 3 is then attached to front end sections of the base plate 4A and upper plate 4D constituting the swiveling frame 4.

Beams 4E and 4F are provided on the right side of the swiveling frame 4, and the control valve unit 12 and the hydraulic fluid reservoir 13, which will be described later, are mounted on the beams 4E and 4F. A motor bracket 4G extending to an upper side from the vicinity of the right side plate 4C is provided on a rear side of the swiveling frame 4, and a drive motor 19 for the sirocco fan 16, which will be described later, is attached to an upper part of the motor bracket 4G.

A breather 4H (shown in FIG. 2 and FIG. 3) is formed in the base plate 4A of the swiveling frame 4, at a lower side of the engine 10, which will be described later. The breather 4H is a slit shape or covered by a net, and cooling water that passes through the radiator 20, described later, and becomes hot is discharged to the outside through this breather 4H.

A counterweight 5 for providing a weight balance for the boom 3 is attached to a rear end section of the swiveling frame 4, the counterweight 5 being formed in an arc shape corresponding to the turning radius.

An external cover 6 is provided so as to cover the outer side of the swiveling frame 4. The external cover 6 is mainly comprised of a right cover 6A, positioned at an upper right side of the swiveling frame 4, for covering the control valve unit 12, described later, the hydraulic fluid reservoirs 13, the sirocco fan 16 and the radiator 20 etc., a left cover (not shown in the drawings), positioned at an upper left side of the swiveling frame 4, for covering the engine 10, described later, a rear cover 6B, positioned at an upper side of the counterweight 5, for covering the engine 10 etc. from an upper side, and a skirt cover 6C for covering the periphery of the swiveling frame 4. An engine chamber 100 is formed by these covers 6A, 6B and 6C.

The right cover 6A and the left cover 6B are made capable of being opened and closed in order to carry out inspection operations and maintenance operations of respective components covered by these covers 6A and 6B. A breather 6D as shown in FIG. 1 is provided in the right cover 6A. The breather 6D is for cooling air to flow for supply to the sirocco fan 16, to be described later, and opens to a position corresponding to an intake side of the sirocco fan 16.

The driver's seat 7 is provided at a front side of the rear cover 6B. The driver's seat 7 is provided to the left in the lateral direction of the swiveling frame 4. A travel lever 8 for causing the lower traveling body 1 to travel is provided at a front side of the driver's seat 7, and operating levers 9 for operating the boom 3 are provided on both left and right sides of the driver's seat 7.

Further to the rear left side of the swiveling frame 4, the engine 10 is provided on the front side of the counterweight 5. The engine 10 is transversely mounted extending in the lateral direction. The engine 10 is a water cooled type that causes cooling water to circulate inside a water jacket (not shown), and is connected to a radiator 20, described later.

A hydraulic pump 11 driven by the engine 10 is attached to a left side of the engine 10. The hydraulic pump 11 provides hydraulic fluid towards the control valve unit etc., described later. The hydraulic pump 11 is connected to the control valve unit 12 and the hydraulic fluid reservoir 13 through hydraulic piping and a hydraulic hose (not shown) etc.

The control valve unit 12 is provided on the right front side of the swiveling frame 4. The control valve unit 12 has a number of control valves for controlling various actuators, and is attached onto beams 4E and 4F. The control valve unit 12 is connected to the hydraulic pump 11, hydraulic fluid reservoir 13, oil cooler 21 etc.

The hydraulic fluid reservoir 13 is provided on the swiveling frame 4 at a rear side of the control valve unit 12. The hydraulic fluid reservoir 13 is attached on the beam 4F, and holds hydraulic fluid to be supplied to the hydraulic pump 11. The hydraulic fluid reservoir 13 is formed as an airtight box-shaped container using a front plate 13A, a rear plate 13B, a left side plate 13C, a right side plate 13D, an upper plate 13E and a base plate 13F. The rear plate 13B cooperates with the cooling air duct 14, described later, to form one side surface defining a cooling air passage 15. The hydraulic fluid reservoir 13 is connected to the control valve unit 12, hydraulic pump 11, oil cooler 21 etc.

The cooling air duct 14 is provided at a rear side of the hydraulic fluid reservoir 13 close to the hydraulic fluid reservoir 13. The cooling air duct 14 connects the sirocco fan 16, which will be described later, with the radiator 20 and the oil cooler 21.

Figure 5:
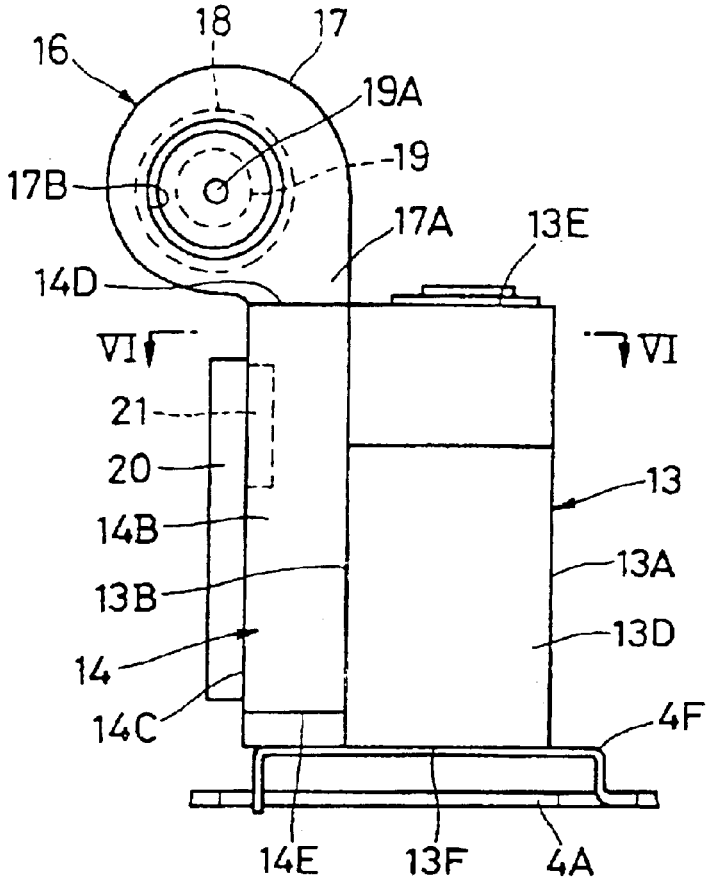
FIG. 5 is a front elevation showing an enlargement of a hydraulic fluid reservoir, a cooling air duct, a sirocco fan, a radiator and an oil cooler.
Figure 6:
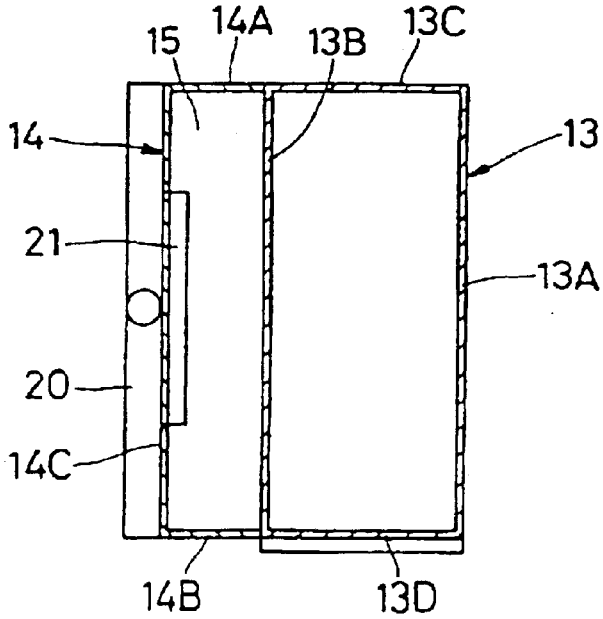
FIG. 6 is a cross sectional drawing along line VI—VI in FIG. 5.

As shown in FIG. 5 and FIG. 6, the cooling air duct 14 comprises a left side plate 14A extending from a left end of the rear plate 13B of the hydraulic fluid reservoir 13 to a rear side of the machine, a right side plate 14B extending from a right end of the rear plate 13B to a rear side, a frame plate-shaped rear plate 14C provided spanning rear ends of each of the side plates 14A and 14B, an upper plate 14D provided offset to the right side at upper parts of the right side plate 14B and the rear plate 14C, and a base plate 14E provided at a lower side of each of the side plates 14A and 14B and the rear plate 14C. By attaching front ends of each of the side plates 14A and 14B to the rear plate 13B of the hydraulic fluid reservoir 13, the cooling air duct 14 formes the cooling air passage 15 together with the rear plate 13B.

The radiator 20, described later, and the sirocco fan 16, as a centrifugal fan above the oil cooler 21, are provided on the cooling air duct 14. The sirocco fan 16 is a centrifugal fan for blowing out air that has been sucked along an axis of an impeller blade, circumferentially of the impeller blade, and is characterized in that it is small and has low noise compared to a propeller fan. The sirocco fan 16 supplies cooling air through the cooling air duct 14 to the radiator 20 and the oil cooler 21.

The sirocco fan 16 is formed in a substantially circular shape with an axis in a lateral direction, and is mainly comprised of a fan casing 17 with external shape like a spiral increasing gradually in radius towards a discharge port 17A, a cylindrical impeller 18 which is capable of rotation inside the fan casing 17 and has a plurality of impeller blades extending axially at an outer peripheral side, and a drive motor 19 which is attached to a motor bracket 4G of the swiveling frame 4 keeping a distance from the left side of the fan casing 17, being a hydraulic motor or electrical motor with an output shaft 19A connected to the impeller 18. The sirocco fan 16 has a discharge port 17A of the fan casing 17 integrally attached to an upper left side of the cooling air duct 14.

By rotationally driving the impeller 18 with the drive motor 19, the sirocco fan 16 sucks air inside the impeller 18 from an intake port 17B (only one side is shown in the drawing) provided opening to both ends in the axial direction of the fan casing 17 and discharges this air from the discharge port 17A of the fan casing 17 under centrifugal force.

The radiator 20, as a heat exchanger, is attached to the rear plate 14C of the cooling air duct 14 below the sirocco fan 16. The radiator 20 cools cooling water of the engine 10 using cooling air from the sirocco fan 16. The radiator 20 is connected to a water jacket of the engine 10 through a hose (not shown). The axis of the sirocco fan 16 does not strictly need to be in the lateral direction, and can also be in the longitudinal direction or inclined slightly upwards or downwards.

The oil cooler 21, as a heat exchanger, is attached to the front surface of the radiator 20, and is positioned inside the cooling air duct 14. The oil cooler 21 uses the cooling air from the sirocco fan 16 to cool hydraulic fluid returned to the hydraulic fluid reservoir 13 from the control valve unit 12. The oil cooler 21 is connected to the control valve unit 12 and the hydraulic fluid reservoir 13.

A partition plate 22 is provided on the swiveling frame 4, around the sirocco fan 16. The partition plate 22 partitions the intake side of the sirocco fan 16, namely the intake port 17B of the fan casing 17, from the exhaust side of the radiator 20 and the oil cooler 21 and the engine 10. For this reason, the partition plate 22 is provided further up than the upper surface of the radiator 20, and enclosing the rear and left sides of the fan casing 17 of the sirocco fan 16. Specifically, the partition plate 22 substantially comprises a lateral plate 22A arranged at a rear side of the fan casing 17 and extending to the left and right, and a longitudinal plate 22B arranged to the left side of the fan casing 17 and extending from the lateral plate 22A to the front.

In this way, the partition plate 22 increases the cooling efficiency of the radiator 20 by sucking only externally cooled air from the breather 6D provided in the external cover 6 into the sirocco fan 16.

Reference numeral 23 represents a canopy for covering above the driver's seat 7 upon which an operator sits. (See FIG. 1)

Operation of the hydraulic excavator of this embodiment having the above-described structure will now be described.

An operator sits in the driver's seat 7 and causes the lower traveling body 1 to travel by operating the travel lever 8. When the working levers 9 are operated, the working unit 3 is made to move up and down and the upper swiveling body 2 is made to swivel, making it is possible to perform excavation operations.

When traveling or carrying out excavation operations as described above, cooling water for the engine 10 is cooled by the radiator 20 and the hydraulic fluid is cooled by the oil cooler 21.

That is, the drive motor 19 of the sirocco fan 16 is driven to cause rotation of the impeller 18. In this way, inflowing external air is sucked into the impeller 18 from the breather 6D prepared in the right cover 6A of the external cover 6 and cooling air is expelled into the cooling air duct 14 from the discharge port 17A of the fan casing 17. Cooling air that has been expelled inside the cooling air duct 14 is supplied to the radiator 20 and the oil cooler 21 through the cooling air passage 15, and cooling water and hydraulic fluid are cooled by the radiator 20 and the oil cooler 21, respectively.

Since the cooling air passage 15 is defined by the cooling air duct 14 and the rear plate 13B of the hydraulic fluid reservoir 13, cooling air flowing through the cooling air passage 15 comes into contact with the rear plate 13B of the hydraulic fluid reservoir 13. Consequently, it is possible to release heat of the hydraulic fluid stored in the hydraulic fluid reservoir 13 into the cooling air flowing through the cooling air passage 15 using the rear plate 13B, so that the hydraulic fluid stored in the hydraulic fluid reservoir 13 can be cooled. Cooling air that has become heated up by passing through the radiator 20 and the oil cooler 21 is discharged to the rear, deflected along the covers 6A and 6B and an inner surface of the counterweight 5 to the engine side on the left, and discharged to the outside from a breather 4H opening to the base plate 4*a* of the swiveling frame 4 at a lower side of the engine 10. The partition plate 22 partitions the intake side (intake port 17B) of the sirocco fan 16 from the exhaust side of the radiator 20 and the oil cooler 21, and from the engine 10. Cooling air that has passed through the radiator 20 and become heated, and air that has become heated due to heat from the engine 10, are prevented from flowing into the sirocco fan 16 again. As a result, the sirocco fan 16 can suck in only cool air sucked in from the breather 6D.

A description will now be given of carrying out inspection and maintenance operations of the sirocco fan 16.

The right cover 6A of the external cover 6 is opened. The sirocco fan 16 is arranged above the radiator 20 etc., in other words, it is arranged at a position where it is easy for an operator to reach in with their hand well within the field of view. Accordingly, the operator can simply and visually inspect the impeller 18 and drive motor 19 etc. of the sirocco fan 16, and it is also possible to efficiently carry out maintenance operations such as cleaning and servicing operations due to faults etc. in a posture that is not uncomfortable.

In this way, according to the first embodiment, since the sirocco fan 16 is provided as a cooling fan inside the engine compartment 100, it is possible to reduce rotation noise of the fan 16. Since the cooling air sucked in by the sirocco fan is fed to the oil cooler 21 and the radiator 20 and then discharged from a lower side of the engine 10, it is possible to feed low temperature air to the oil cooler 21 and the radiator 20, and it is thus possible to improve the cooling efficiency of these heat exchangers. As a result, it is not necessary to increase the size of the sirocco fan 16 and the radiator 20, thus the structural size of the engine compartment 100 can be reduced. It is also not necessary to increase the rotational speed of the fan 16, making it possible to prevent the rotational noise of the fan 16 becoming worse.

The sirocco fan 16 is arranged above the radiator 20 and the oil cooler 21, in other words the sirocco fan 16 is arranged at a position close to the operator. As a result, it is easy to carry out inspection operations and maintenance operations for the sirocco fan 16, thus operability is improved. Since the sirocco fan 16, the radiator 20 and the oil cooler 21 are arranged above or below each other, it is possible to make the longitudinal dimensions of these parts smaller and to make the upper swiveling body 2 smaller.

Since the cooling air duct 14 is defined by the rear plate 13B of the hydraulic fluid reservoir 13 together with the cooling air passage 15, it is also possible to cool the hydraulic fluid stored inside the hydraulic fluid reservoir 13 using the rear plate 13B. Accordingly the efficiency of cooling the hydraulic fluid can be improved.

Because the rear plate 13B of the hydraulic fluid reservoir 13 is used as part of the cooling air duct 14, it is possible to reduce the number of components of the cooling air duct 14, making it possible to improve ease of assembly and to reduce manufacturing costs etc.

Since the intake side of the sirocco fan 16 is partitioned off from the exhaust side of the radiator 20 and the oil cooler 21, and the engine 10 with the partition plate 22, it is possible to prevent cooling air that has become heated by passing through the radiator 20 etc. and air that has become heated by heat from the engine 10 from being sucked back into the sirocco fan 16. Therefore, because the sirocco fan 16 can supply cool air sucked in from the breather 6D to the radiator 20 as cooling air, it is possible to efficiently cool the engine cooling water and the hydraulic oil. Accordingly, reliability can be improved.

By providing the breather 6D at a high position of the right cover 6A, it is possible to suppress the invasion of dust etc. Accordingly, lowering efficiency of cooling the radiator 20 etc., can be suppressed and simplification of cleaning operations etc., can be achieved.

The structure is such that the hydraulic pump 11 is arranged offset to the right side of the swiveling frame 4, the sirocco fan 16 is separated from the engine 10, and the radiator 20, the oil cooler 21, the sirocco fan 16, the hydraulic fluid reservoir 13 and the control valve unit 12 are arranged offset to the right side of the swiveling frame 4 together with the hydraulic pump 11. Consequently, it is possible to reduce the length of lines (not shown) for respectively connecting the hydraulic pump 11 and the hydraulic fluid reservoir 13, the hydraulic pump 11 and the control valve unit 12, the control valve unit 12 and the oil cooler 21, the oil cooler 21 and the hydraulic fluid reservoir 13, and the control valve unit 12 and the hydraulic fluid reservoir 13.

As a result, it is possible to simplify handling at the time of connecting each of the lines to improve operability. It is possible to arrange the lines at a position separated from the driver's seat 7, and it is possible to provide a comfortable working environment by suppressing pulsating emission noise from hydraulic piping around the driver's seat 7. It is possible to widen a space around the driver's seat 7, and this point also adds to improvement in the working environment.

Because the sirocco fan 16 is separated from the engine 10 and driven by the motor 19, the sirocco fan 16, radiator 20 and oil cooler 21 can be arranged offset to the right side of the swiveling frame 4. Therefore, the hydraulic pump 11 provided on the engine 10 can be made central, and it is possible to arrange the sirocco fan 16, the radiator 20 and the oil cooler 21 in a free relationship.

It is therefore possible to increase the degree of freedom of the arrangement relationship between the hydraulic pump 11, the radiator 20 the oil cooler 21 and the sirocco fan 16. It is possible to arrange these components efficiently on the upper turntable 2, and it is possible to reduce the size of the upper swiveling body 2. The upper swiveling body 2 is capable of making small turns, and is suitable for use in a mini excavator.

Since the axis of the sirocco fan 16 is provided in the lateral direction, cooling air expelled from the sirocco fan 16 passes through the oil cooler 21 and the radiator 20 and is then deflected to the side of the engine 10. This means that when providing arrangement space for the sirocco fan 16 at the right side of the driver's seat 7, it is possible to efficiently arrange the sirocco fan 16, as well as to provide the breather 6D separated from the engine 10 and to suppress the outward flow of engine noise from the engine. Cooling air that has been guided to the engine 10 side is discharged from the breather 4H provided at the lower side of the engine 10 to the outside, which makes it possible to reduce noise.

Second Embodiment

A second embodiment of a construction machine of the present invention will now be described with reference to FIG. 7 and FIG. 8.

The second embodiment is characterized in that the hydraulic fluid reservoir has a side surface forming the cooling air passage as an inclined surface inclining in a direction towards the heat exchanger side, wherein heat dissipating fins are provided projecting from the side surface defining a cooling air passage for the hydraulic fuel tank. With the second embodiment, the same reference numerals are used for structural elements that are the same as those in the first embodiment described above, and description of those parts will be omitted.

Figure 7:
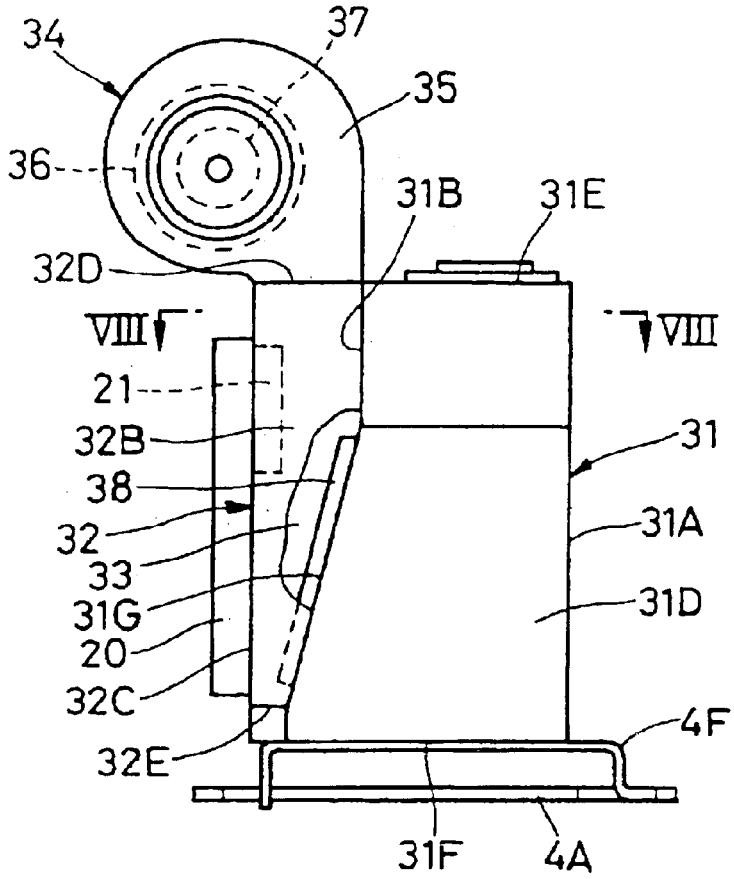
FIG. 7 is a front elevation showing a hydraulic fluid reservoir, cooling air duct, sirocco fan and heat radiating fan of a second embodiment of the present invention, together with a radiator and oil cooler.
Figure 8:
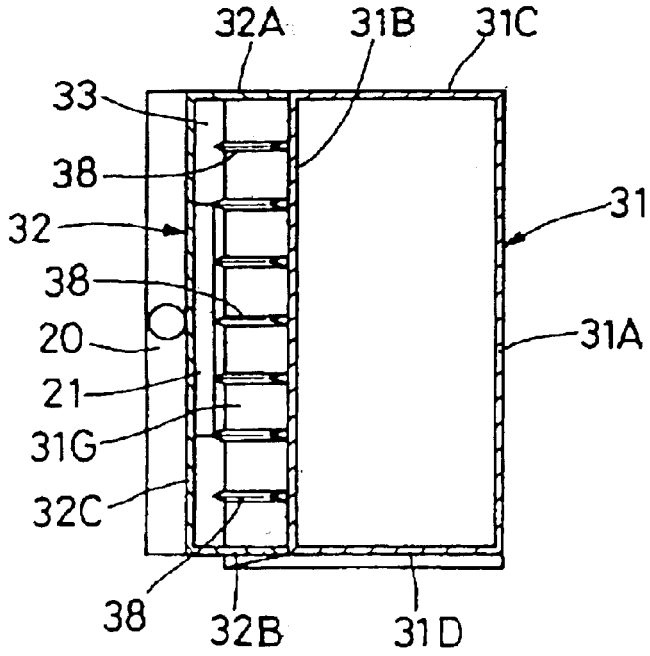
FIG. 8 is a cross sectional drawing along line VIII—VIII in FIG. 7.

As shown in FIG. 7 and FIG. 8, the hydraulic fluid reservoir 31 of the second embodiment is formed as a box-like container tightly closed by a front plate 31A, a rear plate 31B, a left side plate 31C, a right side plate 31D an upper plate 31E and a base plate 31F. A lower portion of the rear plate 31B, that is below the central part in the upward and downward direction of the rear plate 31B forms an inclined surface 31G inclined towards the radiator 20, and the side plates 31C and 31D are formed with the undersides widening out corresponding to the inclined surface 31G.

A cooling air duct 32 is provided at behind and adjoining the rear side of the hydraulic fluid reservoir 31. The cooling air duct 32 is formed from a left side plate 32A, a right side plate 32B, a rear plate 32C, an upper plate 32D and a base plate 32E, and the side plates 32A and 32B are individually formed with their undersides inclined along the inclined surface 31G of the hydraulic fluid reservoir 31.

The cooling air duct 32 defines a cooling air passage 33 together with the rear plate 31B by attaching a front end section of each of the side plates 32A and 32B to the rear plate 31B (inclined surface 31G) of the hydraulic fluid reservoir 31.

A sirocco fan 34 constituting a centrifugal fan of the second embodiment is provided on the cooling air duct 32 above the radiator 20 and the oil cooler 21. The sirocco fan 34 is comprised of a casing 35, an impeller 36 and a drive motor 37, similarly to the sirocco fan 16 of the first embodiment.

A plurality of heat dissipating fins 38, . . . , are provided on the rear plate 31B of the hydraulic fluid reservoir 31. Each heat dissipating fin 38 efficiently releases heat of the hydraulic fluid inside the hydraulic fluid reservoir 31 into cooling air flowing through the cooling air passage 33. Each cooling fin 38 is provided on the inclined surface 31G extending in upward and downward directions defining the flow through direction of the cooling air and arrayed in the lateral direction.

Substantially the same effects as those of the previously described first embodiment can also be obtained with the second embodiment having this type of structure.

Further, according to the second embodiment, since the inclined surface 31G inclined towards the radiator 20 is formed on the rear plate 31B of the hydraulic fluid reservoir 31, it is possible to guide cooling air towards the radiator 20 etc., so that efficiency of cooling the cooling water and the hydraulic fluid can be improved. Since the cooling air collides actively with the inclined surface 31G of the hydraulic fluid reservoir 31, it is also possible to efficiently cool hydraulic fluid inside the hydraulic fluid reservoir 31 using this inclined surface 31G. Since the inclined surface 31G enlarges the volume of the hydraulic fluid reservoir 31, it is also possible to prolong the time between hydraulic fluid replacement, and to reduce the size of the hydraulic fluid reservoir 31.

Since the plurality of heat dissipating fins 38 protruding outwards are provided on the rear plate 31B of the hydraulic fluid reservoir 31 and are positioned on the inclined surface 31G, it is possible to enlarge the surface area of the rear plate 31B and to dramatically improve the efficiency of cooling the hydraulic fluid.

Third Embodiment

Figure 9:
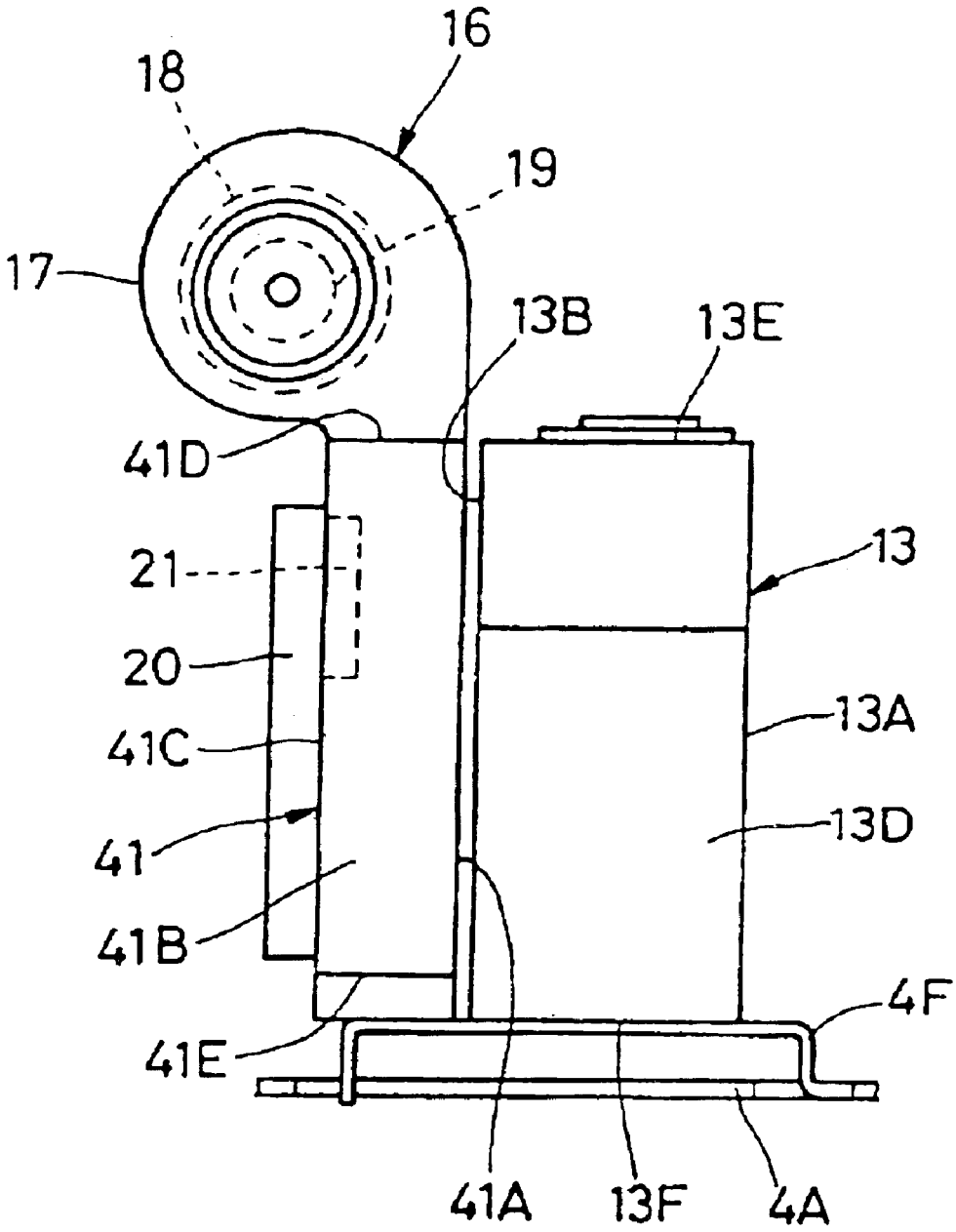
FIG. 9 is a front elevation showing a cooling air duct and sirocco fan of a third embodiment of the present invention, together with a hydraulic fluid reservoir, radiator and oil cooler.

A third embodiment of a construction machine of the present invention will now be described with reference to FIG. 9.

The third embodiment is characterized in that the hydraulic fluid reservoir and the cooling air duct are provided in separate bodies. With the third embodiment, the same reference numerals are used for structural elements that are the same as those in the first embodiment described above, and description of those parts will be omitted.

The cooling air duct 41 of the third embodiment is provided adjacent to a rear side of the hydraulic fluid reservoir 13, and there is a slight gap between the cooling air duct 41 and the hydraulic fluid reservoir 13. Here, the cooling air duct 41 comprises a front plate 41A facing the rear plate 13B of the hydraulic fluid reservoir 13 with a slight gap between the front plate 41A and the rear plate 13B, a left side plate (not shown) extending from a left end of the front plate 41A towards the rear of the swiveling frame, a right side plate extending from a right side of the front plate 41A to the rear, a frame-shaped rear plate 41C provided spanning the rear ends of the right side plate 41B and left side plate, an upper plate 41D provided offset to the right side at upper sections of the front plate 41A, the right side plate 41B, and the rear plate 41C, and abase plate 41E provided at the bottoms of the front plate 41A, the right side plate 41B and the rear plate 41C. A cooling passage (not shown) is defined inside the cooling air duct 41, enclosed by the front plate 41A, the right side plate 41B and the rear plate 41C.

According to the third embodiment configured in this way, since the hydraulic fluid reservoir 13 and the cooling air duct 41 are provided separately, it is possible to prevent vibration interference due to differences in vibration frequency between the two. Since the cooling air duct 41 is adjacent to the hydraulic fluid reservoir 13 with a slight gap, it is also possible to transfer heat of the hydraulic fluid inside the hydraulic fluid reservoir 13 to the cooling air duct 41, and to release the heat into the cooling air.

The first embodiment was described giving an example for the case where the oil cooler 21 was provided at a front side of the radiator 20. However, the present invention is not thus limited, and it is also possible, for example, to have a structure where the oil cooler 21 is provided at a rear side of the radiator 20. It is also possible to similarly apply this structure to other embodiments.

The first embodiment was described giving an example for the case where the drive motor 19 of the sirocco fan 16 was attached to the motor bracket 4G extending from the swiveling frame 4. However, the present invention is not thus limiting, and it is also possible to have a structure, for example, where the drive motor 19 is attached to the fan casing 17 via a bracket or the like. It is also possible to similarly apply this structure to other embodiments.

With the first embodiment, the sirocco fan 16 was described as having an impeller 18 rotationally driven by the drive motor 19. However, the present invention is not thus limiting, and it is also possible to have a structure where, for example, the impeller 18 is connected to an output shaft side of the engine 10 and rotationally driven by the engine 10. It is also possible to similarly apply this structure to other embodiments.

With the first embodiment, description was given with an example where a sirocco fan 16 was applied as a centrifugal fan. However, the present invention is not thus limited and it is also possible, for example, to apply a centrifugal fan constituted by various types of multi-blade fan, multi-layer disk fan etc.

Fourth Embodiment

A fourth embodiment of a construction machine of the present invention will now be described with reference to FIG. 10–FIG. 16.

Figure 10:
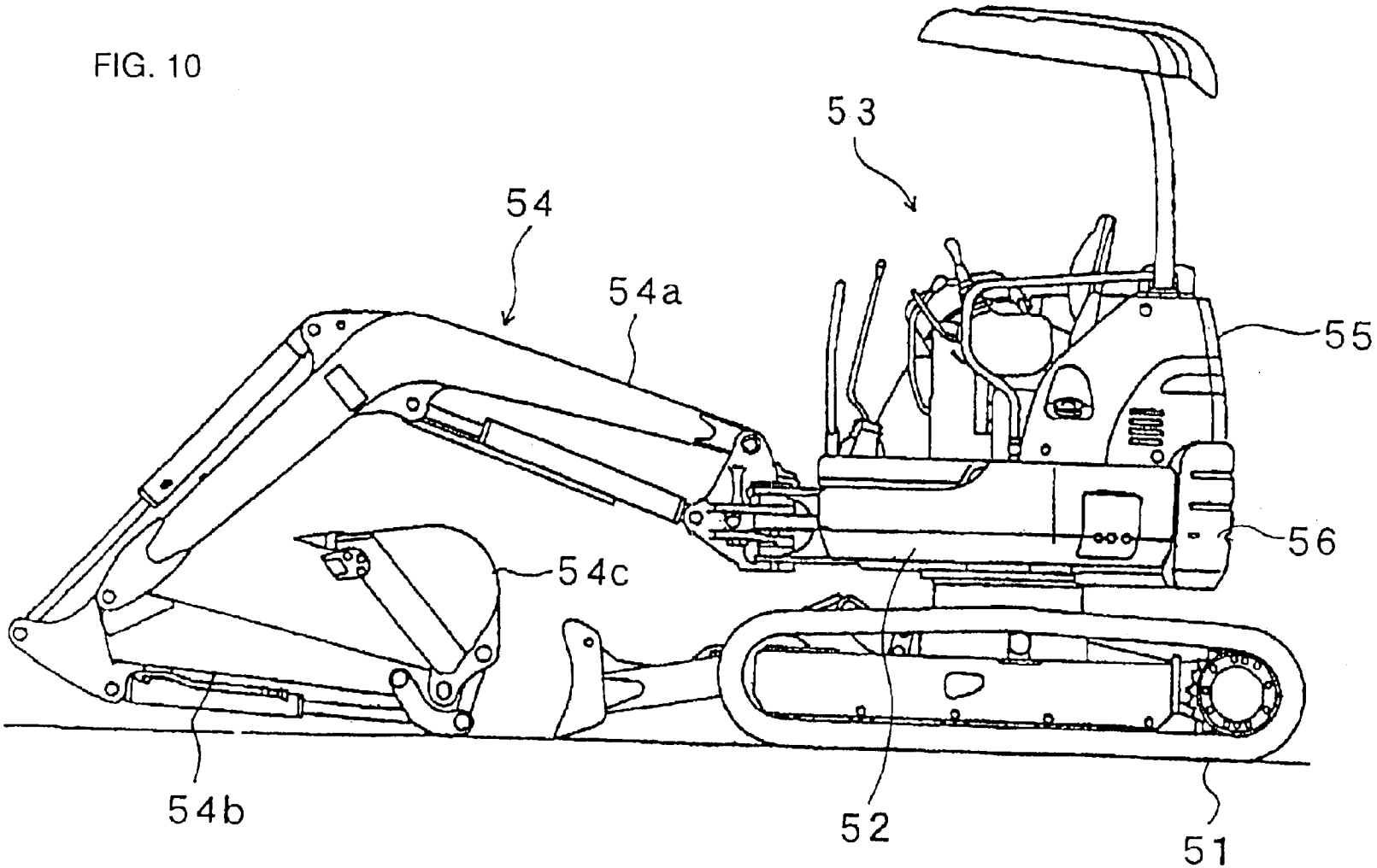
FIG. 10 is a front elevation showing a hydraulic excavator to which a fourth embodiment of the present invention is applied.
Figure 11:
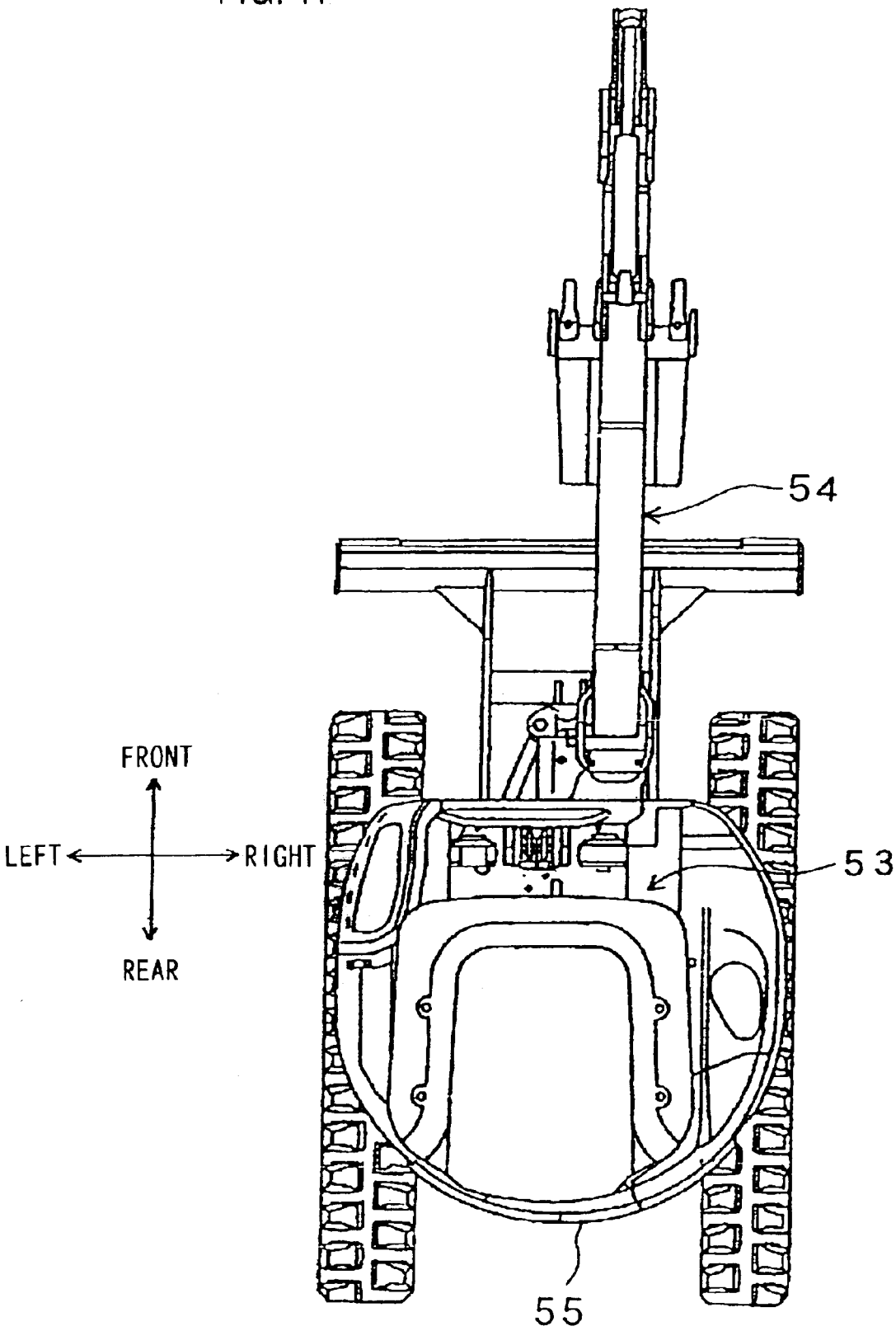
FIG. 11 is a plan view showing a hydraulic excavator to which the fourth embodiment of the present invention is applied.

FIG. 10 is a front elevation of a hydraulic excavator of the fourth embodiment, and FIG. 11 is a plan view of this construction machine. As shown in FIG. 10 and FIG. 11, the hydraulic excavator comprises a traveling body 51, a swiveling body 2 that is provided on the traveling body 51 and is capable of swiveling, an operator's seat section 53 provided offset to the left side of a frame (swiveling frame 62) of the swiveling body 2, and an operating section 54 made up of a boom 54*a* movably attached to a right side of the swiveling frame 62, an arm 54*b* and a bucket 54*c*. An engine unit 55 and a counterweight 56 are arranged behind the operator's seat section 53.

Figure 12:
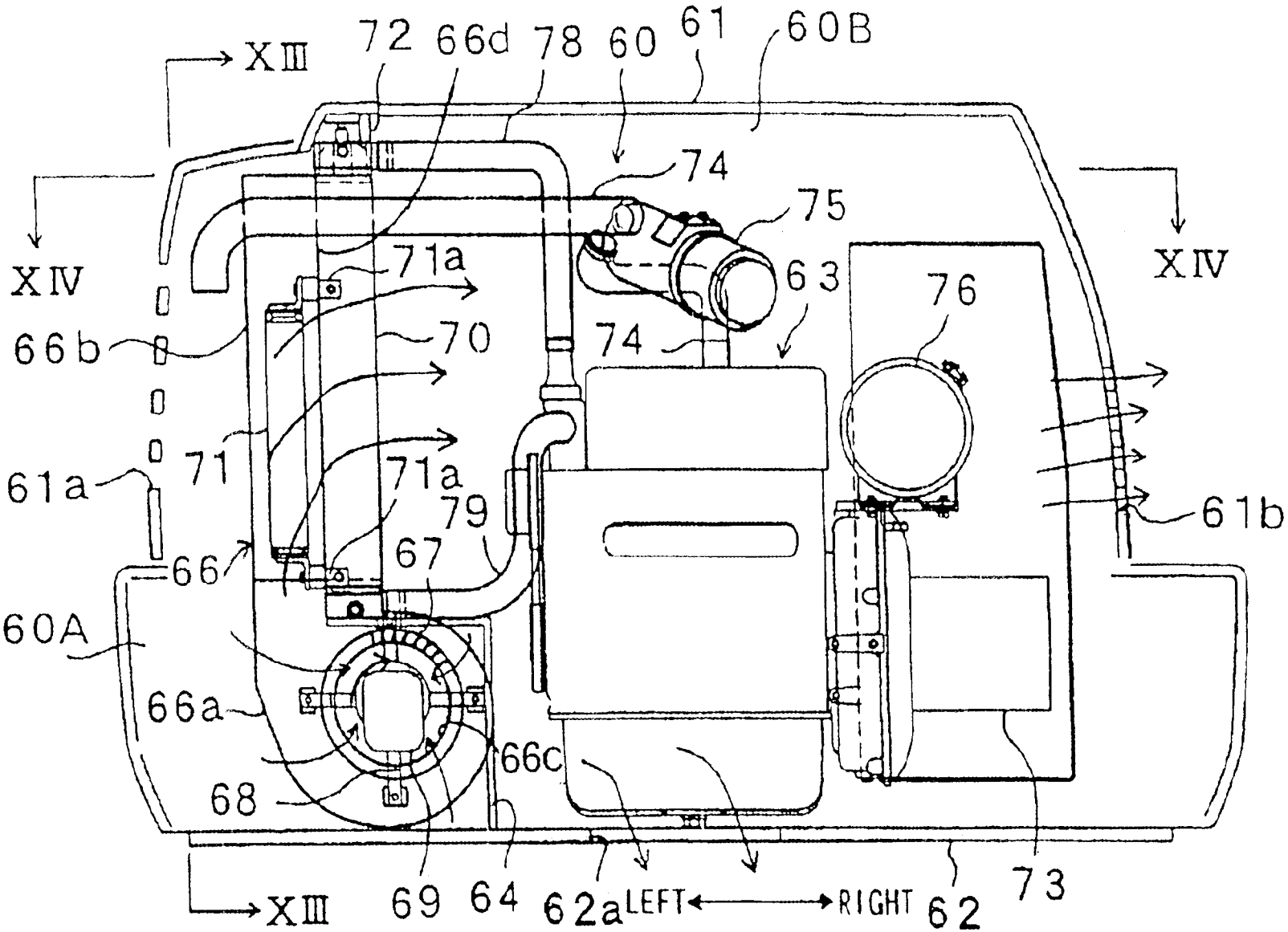
FIG. 12 is a cross sectional drawing showing arrangement of an engine unit of the fourth embodiment of the present invention.
Figure 13:
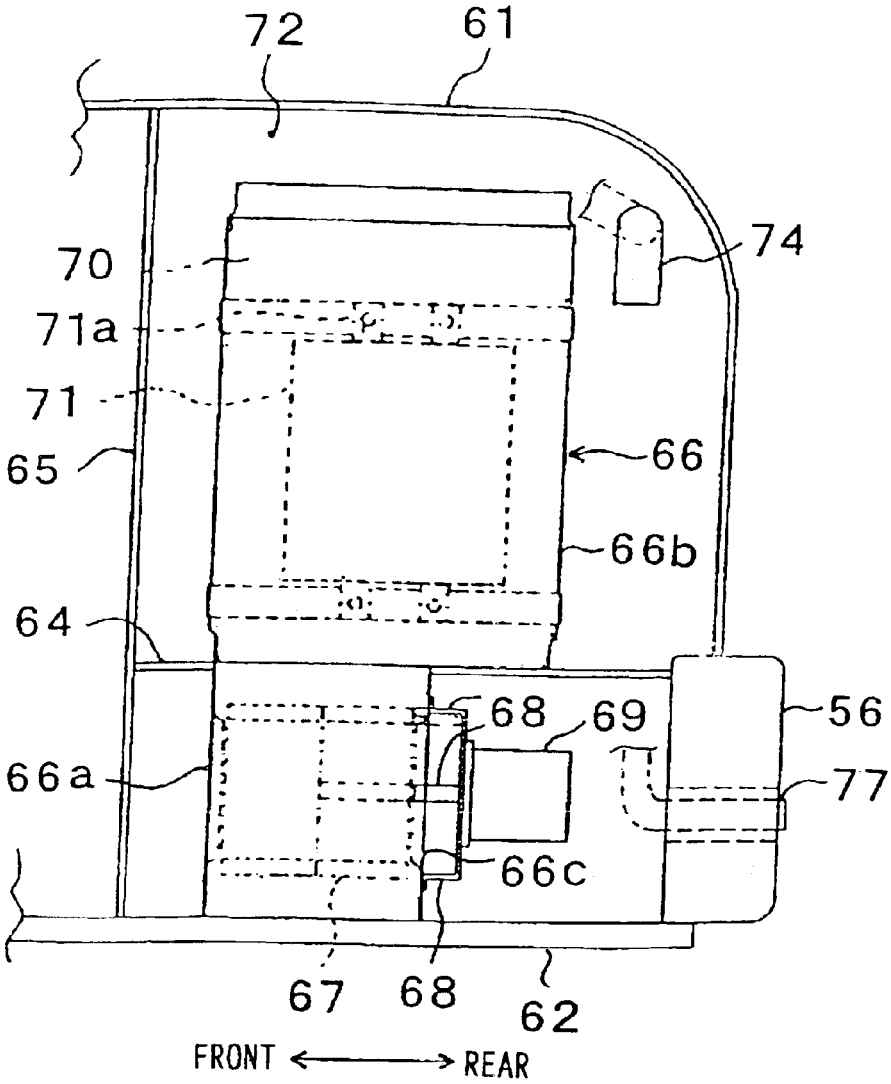
FIG. 13 is a cross sectional view along line XIII—XIII in FIG. 12.
Figure 14:
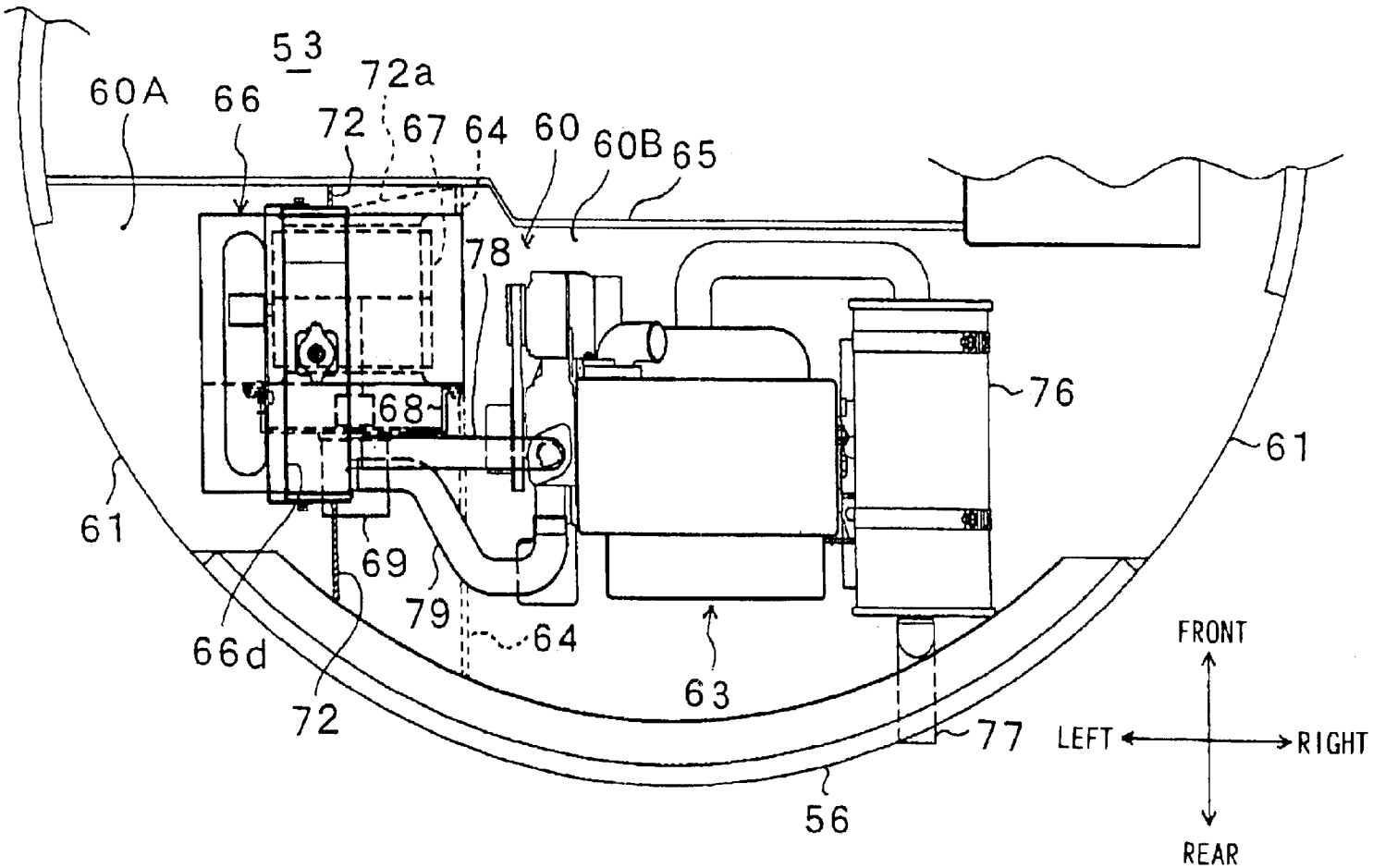
FIG. 14 is a cross sectional view along line XIV—XIV in FIG. 12.

FIG. 12 is a cross sectional drawing of the engine unit 55 in a widthwise direction of the machine (looking from the rear of the machine), FIG. 13 is a cross section along line XIII—XIII of FIG. 12 (looking from the left of the machine), and FIG. 14 is a cross section along line XIV—XIV of FIG. 12 (looking from above the machine). An engine compartment 60 sealed by a cover 61 is formed behind the operator's seat section 53, and an engine 63 is mounted on the swiveling frame 62 substantially in the center of the engine compartment 60.

As shown in FIG. 12, an air intake port 61*a* and an air exhaust port 61*b* are respectively formed in the left and right covers 61, and an air exhaust port 62*a* is formed in the swiveling frame 62 beneath the engine 63. As will be described later, cooling air passes through the inside of the engine compartment 60 via these openings 61*a*, 61*b* and 62*a*. A partition plate 64 having a substantially L-shaped cross section is provided extending in the longitudinal direction of the machine, at the left of the engine 63. A lower surface of the partition plate 64 is fixed to the swiveling frame 62, a front end surface of the partition plate 64 is fixed to a bulkhead 65 between the operator's seat section 53 and the engine compartment, and a rear end surface of the partition plate 64 is fixed to the counterweight 56.

Figure 15:
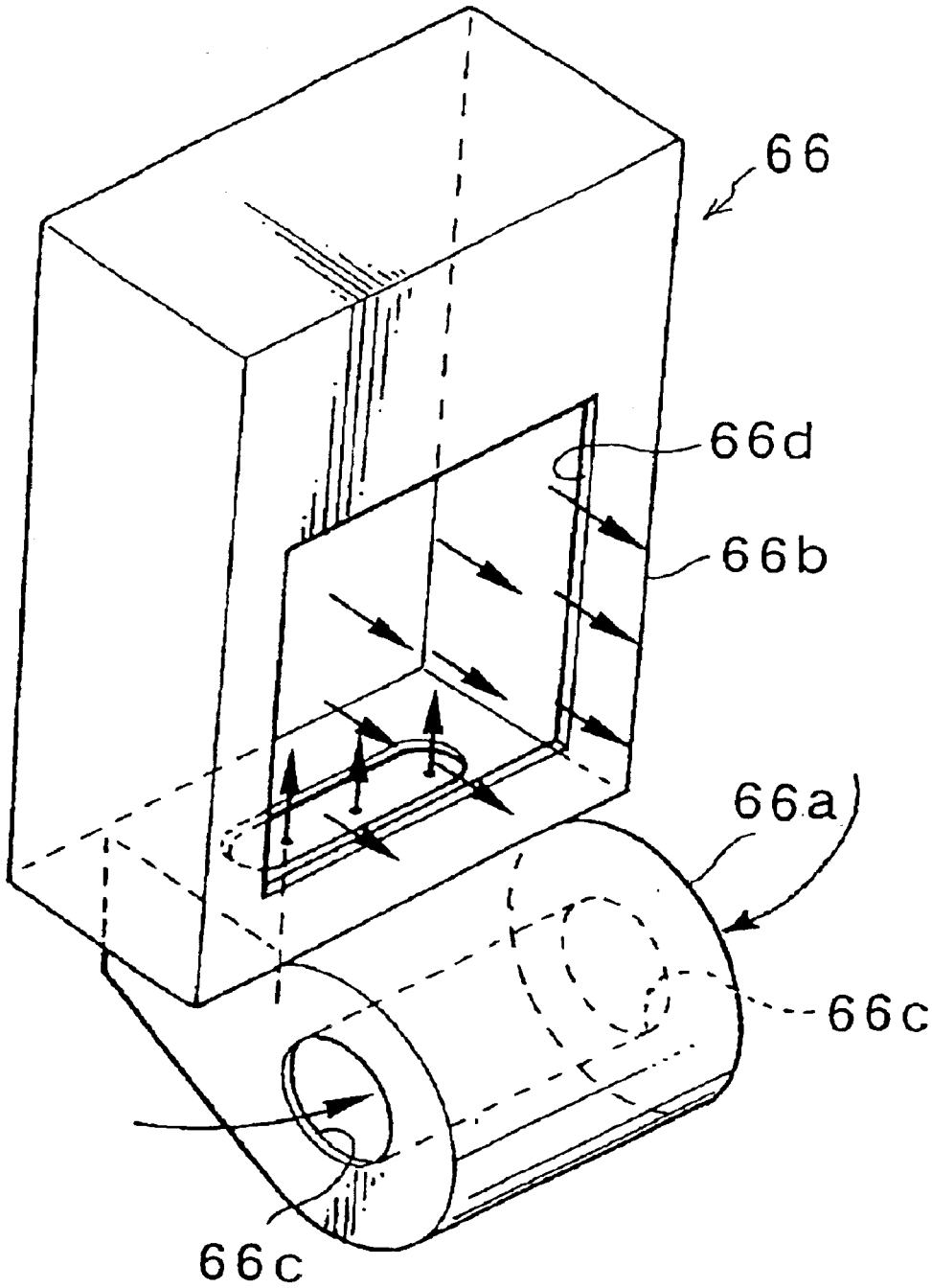
FIG. 15 is an external perspective view showing a duct of the fourth embodiment of the present invention.

As shown in a perspective view of FIG. 15, a duct 66 having a scroll section 66*a* and a straight section 66*b* connecting to the scroll section 66*a* is arranged to the left of the partition plate 64 in a vertical direction of the machine, and the scroll section 66*a* is fixed to the swiveling frame 62 and the partition plate 64. An intake port 66*c* for sucking in cooling air is formed in a front section and a rear section of the scroll section 66*a*, and a blowout opening 66*d* for blowing out cooling air is formed in a right end section of the straight section 66*b*. As shown in FIGS. 12–14, a sirocco fan 67 having a rotational shaft in the longitudinal direction of the machine is housed in an inner side of the scroll section 66*a*. A plurality of stays 68 (four in the drawing) are fixed to the rear surface of the scroll section 66*a*, and a hydraulic motor 69 is attached to the stays 68. An output shaft of the hydraulic motor 69 is linked to the rotational shaft of the sirocco fan 67 through the intake port 66*c*.

A radiator 70 is attached to the blowout opening 66*d* above the sirocco fan 67 in a vertical direction so as to completely cover the blowout opening 66*d*, and a lower end of the radiator 70 is fixed to an upper surface of the partition plate 64. A oil cooler 71 is arranged to the left of the radiator 70 and substantially parallel to the radiator 70, and the oil cooler 71 is fixed to the radiator 70 through a bracket 71*a*. A partition plate 72 is provided between an upper end section and front and rear end sections of the radiator 70 in a machine longitudinal direction, and the cover 61 and the bulkhead 65, and the engine compartment 60 is divided into left and right portions (respectively called a low temperature chamber 60A and a high temperature chamber 60B) with this partition plate 72 and the partition plate 64 and the duct 66. The low temperature chamber 60A and the high temperature chamber 60B are linked through the intake port 66*c*, duct 66 and blowout opening 66*d*.

A hydraulic pump 73 driven by the engine 63 is provided to the right of the engine 63. The hydraulic motor 69 is driven by discharged hydraulic fluid from the hydraulic pump 73, and the sirocco fan 67 rotates. An intake pipe 74 is connected to the engine 63, an air cleaner 75 is provided mid-way along the intake pipe 74, and a tip end section of the intake pipe 74 penetrates through the partition plate 72 and reaches the low temperature chamber 60A. A silencer 76 is arranged above the hydraulic pump 73, and a tip end of an exhaust pipe 77 connected to the silencer 76 penetrates through the counterweight 56 and projects out to the rear of the machine. Hoses 78 and 79, for passing cooling water, are connected to the radiator 70. Although not illustrated, hoses for passing hydraulic fluid are also connected to the oil cooler.

Next, operation of the construction machine of the fourth embodiment will be described.

If the sirocco fan 67 is rotated by rotation of the hydraulic motor 69, cooling air at substantially atmospheric temperature flows in from the air intake port 61*a* of the left side cover 61 to the inside of the low temperature chamber 60A. This cooling air is sucked into the duct 66 from the intake port 66*c* as shown by the arrow in FIG. 12. Sucked in air changes direction along the duct 66, passes sequentially through the oil cooler 71 and the radiator 70, and performs heat exchange with hydraulic fluid inside the oil cooler 71 and cooling water inside the radiator 70. Air passing through the duct 66 is low temperature, and is passing at a high speed since the passage area is restricted by the duct 66. As a result, it is possible to efficiently cool the oil cooler 71 and the radiator 70. Cooling air that has risen in temperature due to heat exchange is fed from the blowout opening 66*d* to the high temperature chamber 60B, passes around the engine 63 and hydraulic pump 73 etc. to cool the surfaces of these components, and then some of the air is discharged from the air exhaust port 62*a* to the outside of the chamber while the remaining air is discharged from the air exhaust port 61*b*.

After air in the low temperature chamber 60A has been sucked inside the intake pipe 74 and filtered by the air cleaner 75, it flows into cylinders of the engine 63. This inflowing air is compressed in the cylinders, then mixed with fuel for explosive combustion, followed by sound damping by the silencer 76 before being discharge to the rear of the machine through the exhaust pipe 77. Energy generated at this time is conveyed to a crankshaft, and the crankshaft is driven.

With the fourth embodiment thus configured, the sirocco fan 67 is provided as a cooling fan inside the engine compartment 60, and cooling air sucked in by the sirocco fan 67 is blown around the engine 63 and the hydraulic pump 73 after being blown to the oil cooler 71 and the radiator 70, which means that it is possible to reduce rotational noise of the fan 67, as well as to blow low temperature air to the oil cooler 71 and the radiator 70 and improve the cooling efficiency of these heat exchangers. As a result, there is no need to increase the size of the fan 67 and the radiator 70, and it is possible to make the engine compartment 60 small in size. There is also no need to increase the rotational speed of the fan 67, and it is possible to prevent degradation in rotational noise of the fan 67. The rotational shaft of the sirocco fan 67 is arranged in the horizontal direction, with the oil cooler 71 and the radiator 70 provided above the rotational shaft, and cooling air from the sirocco fan 67 being blown to the oil cooler 71 and radiator 70 through the duct 66, which means that space efficiency inside the engine compartment 60 is improved.

Since the engine compartment 60 is divided into the left and right portions with the partition plates 64 and 72, the partition plates 64 and 72 act as heat shielding plates making it possible to suppress temperature rise of the low temperature chamber 60A due to radiation (radiated heat etc.) from the engine 63. As a result, the temperature of the cooling air is dramatically lowered, and cooling efficiency is improved. Because the sirocco fan 67, oil cooler 71 and radiator 70 are arranged behind the operator's seat section 53 and the engine 63 is arranged to the right of the radiator 70, that is, since the operator's seat section 53 comes into contact with the low temperature chamber 60A more often through the bulkhead 65, rise in temperature of the operator's seat section 53 can be suppressed, which is obviously more comfortable. It is also possible to arrange the partition plate 72 to the right so that the rear surface of the operator's seat section 53 comes into contact with the low temperature chamber 60A even more often (72*a* in FIG. 14). Since a tip end of the intake pipe 74 is arranged in the low temperature chamber 60A, air at substantially the same temperature as the outside atmosphere is guided into the cylinders of the engine 63, and combustion efficiency is improved.

Figure 16:
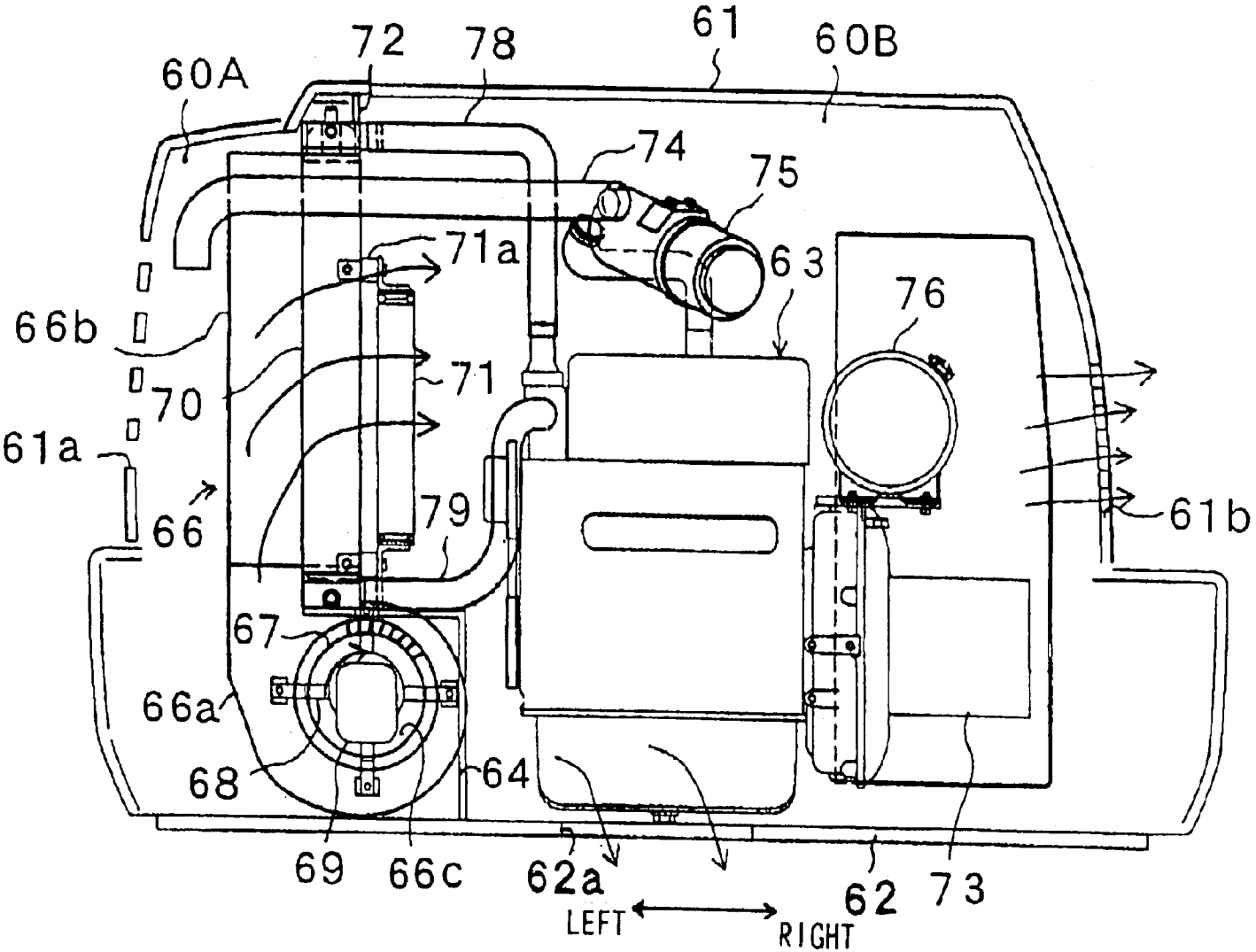
FIG. 16 is a drawing showing a modification of FIG. 12.

If it is desired to make the cooling efficiency of the radiator 70 higher than that of the oil cooler 71, then it is possible, as shown in FIG. 16, to arrange the radiator 70 further upstream than the oil cooler 71, that is, to the left of the oil cooler 71. In this way, lower temperature air is blown to the radiator 70 and cooling efficiency is improved.

Fifth Embodiment

A fifth embodiment of a construction machine of the present invention will now be described with reference to FIG. 17.

Figure 17:
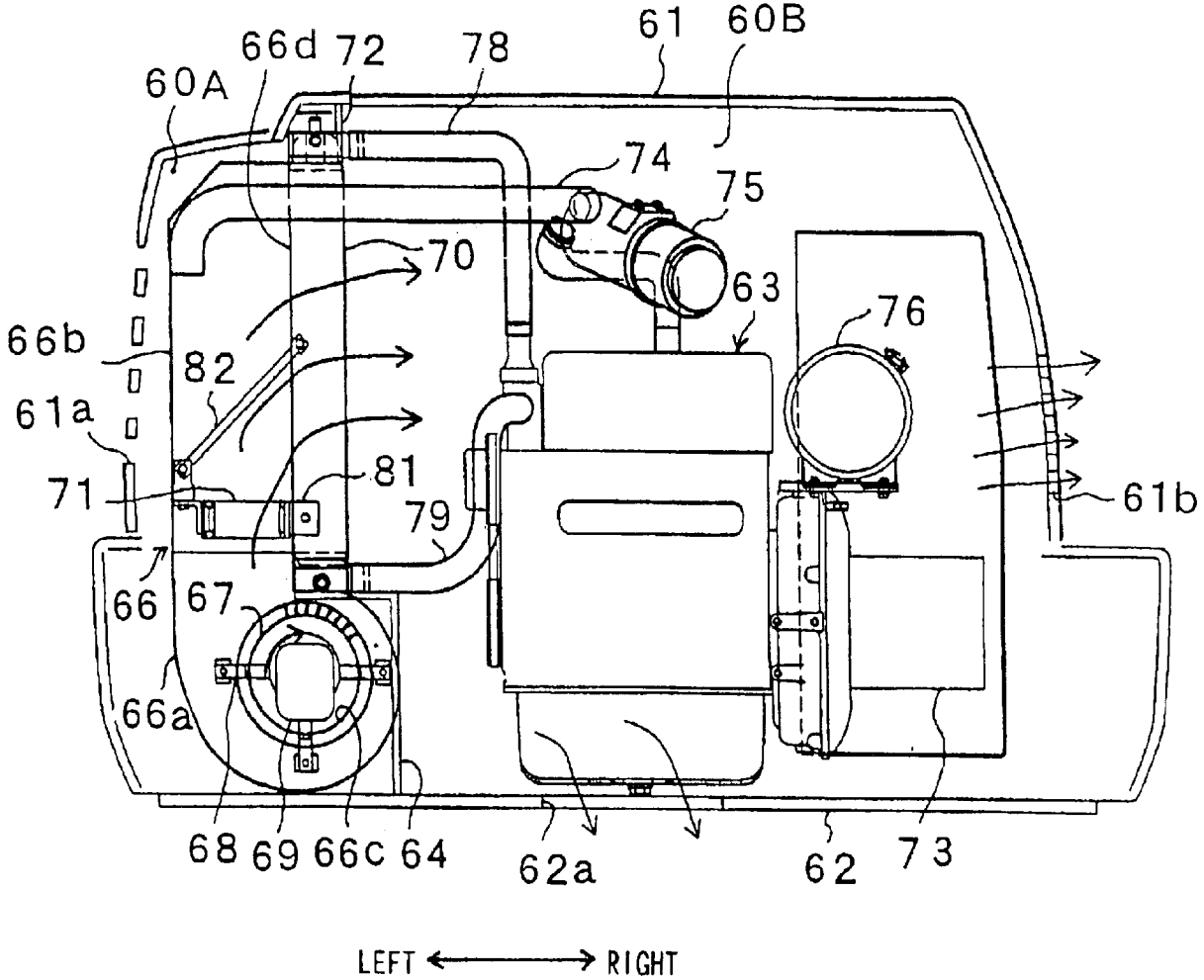
FIG. 17 is a cross sectional drawing showing arrangement of an engine unit of a fifth embodiment of the present invention.

FIG. 17 is a longitudinal cross section of an engine unit 55 of the fifth embodiment. Points that are the same as in FIG. 12 have the same reference numerals, and the following description will focus on points of difference. The fifth embodiment is different from the fourth embodiment in the arrangement of the oil cooler 71. As shown in FIG. 17, the oil cooler 71 is arranged substantially horizontally to the left of the radiator 70, and is supported from the radiator 70 through a bracket 81 at one end of the oil cooler 71 and an elongated support bracket 82 at the other end. In this way, the oil cooler 71 is arranged at a place where a passage area is smaller than the vent section (blowout opening 66*d*) of the duct 66, and is arranged substantially vertically with respect to the passage inside the duct 66, namely vertically with respect to flow of cooling air.

By arranging the oil cooler 71 in this way, cooling air passes substantially horizontally between fins of the oil cooler 71 and air resistance is made small. Also, cooling air flows in uniformly over the entire oil cooler 71 and the hydraulic oil is uniformly cooled. Since the oil cooler 71 is arranged at a location where the passage area is small, the amount of cooling air that passes per unit area of the oil cooler 71 increases, and it is possible to make the oil cooler 71 small in size. With respect to a limit that does not obstruct flow of cooling water from the upper tank to the lower tank of the radiator 70, it is also possible to provide the radiator 70 in an inclined manner, and it is therefore also possible to arrange the radiator 70 vertically with respect to the passage at a place where passage area inside the duct 66 is small.

Sixth Embodiment

A sixth embodiment of a construction machine of the present invention will now be described with reference to FIG. 18 and FIG. 19.

Figure 18:
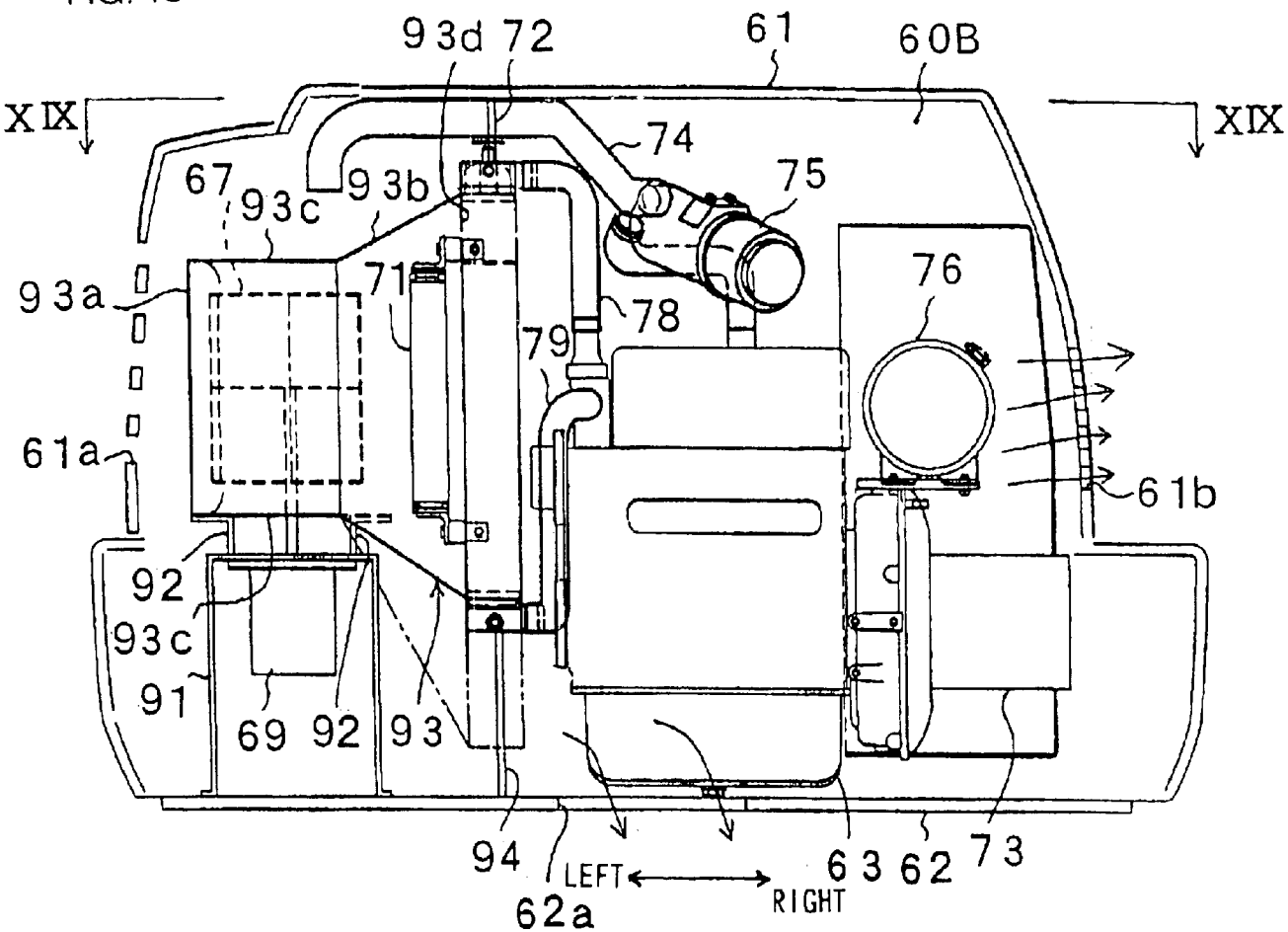
FIG. 18 is a cross sectional drawing showing arrangement of an engine unit of a sixth embodiment of the present invention.
Figure 19:
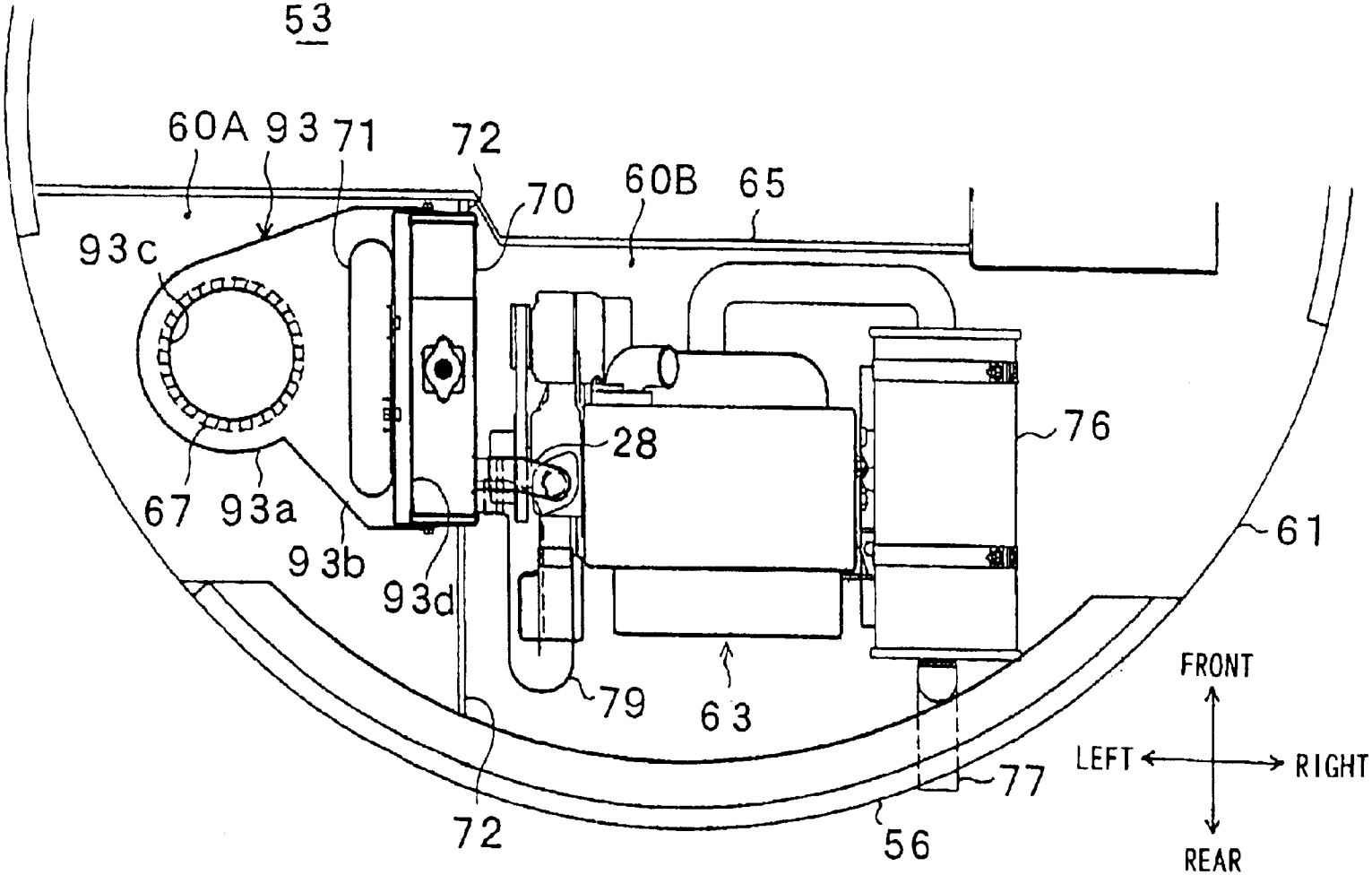
FIG. 19 is a cross sectional view along line XIX—XIX in FIG. 18.

FIG. 18 is a cross section in the longitudinal direction of the machine of an engine unit 55 of the sixth embodiment, and FIG. 19 is a cross section along line XIX—XIX of FIG. 18. Points that are the same as those in FIG. 12 and FIG. 14 have the same reference numerals, and the following description will focus on points of difference. The sixth embodiment is different from the fourth embodiment in the arrangement of the sirocco fan 67. Compared to the fourth embodiment where the rotational shaft of the sirocco fan 67 is arranged in the horizontal direction, with the sixth embodiment the fan is arranged vertically, as described in the following.

As shown in FIG. 18 and FIG. 19, a base platform 91 is fixed to the left of the engine compartment 60 on an upper surface of the swiveling frame 62, and a duct 93 is supported on an upper surface of the base platform 91 through a stay 92. The duct 93 is made up of a substantially cylindrical cylinder section 93*a*, and an extension section 93*b* opening out in a horn shape from a peripheral surface of the cylindrical section 93*a* to the right. Openings 93*c* are respectively formed in upper and lower surfaces of the cylinder section 93*a*, and a discharge opening 93*d* is formed in a right end section of the extension section 93*b*. A hydraulic motor 69 is attached to the base platform 91, a sirocco fan 67 having a rotation shaft in the vertical direction is housed in the cylinder section 93*a*, and an output shaft of the hydraulic motor 69 is coupled to the rotation shaft of the sirocco fan 67 through an intake port. The radiator 70 is attached to a discharge opening 93*d*, and the oil cooler 71 is fixed to the left of the radiator 70. A lower part of the radiator 70 is supported in an upper end of a flat plate-shaped partition plate 94.

With this type of structure, cooling air flowing into the engine compartment 60 due to rotation of the sirocco fan 67 flows into the duct 93 through intake port 93*c*. This inflowing air passes through the oil cooler 71 and the radiator 70 and is discharged from the discharge opening 93*d*, passes around the hydraulic pump 73 and is exhausted from the air exhaust ports 61*b* and 62*a*. In this way, low temperature cooling air passes through the oil cooler 71 and the radiator 70, and cooling efficiency is improved.

Since the upstream side of the flow of cooling air (low temperature chamber 60A) is arranged at a rear surface of the operator's seat section 53, rise in temperature of the operator's seat section 53 is suppressed. Because the rotational shaft of the sirocco fan 67 is provided in a vertical direction and the radiator 70 is arranged to the right of the sirocco fan 67, a space is formed beneath the radiator 70 and it is possible to extend the radiator 70 downwards as shown by the two-dot chain line in FIG. 18. By doing this, the heat dissipating area of the radiator 70 is increased to improve cooling efficiency, and it is possible to reduce the rotational speed of the fan in proportion to this increased cooling efficiency to reduce the fan noise. Air resistance is slight because the oil cooler 71 and the radiator 70 are arranged vertically with respect to the flow of cooling air.

Seventh Embodiment

A seventh embodiment of the present invention will now be described with reference to FIG. 20.

Figure 20:
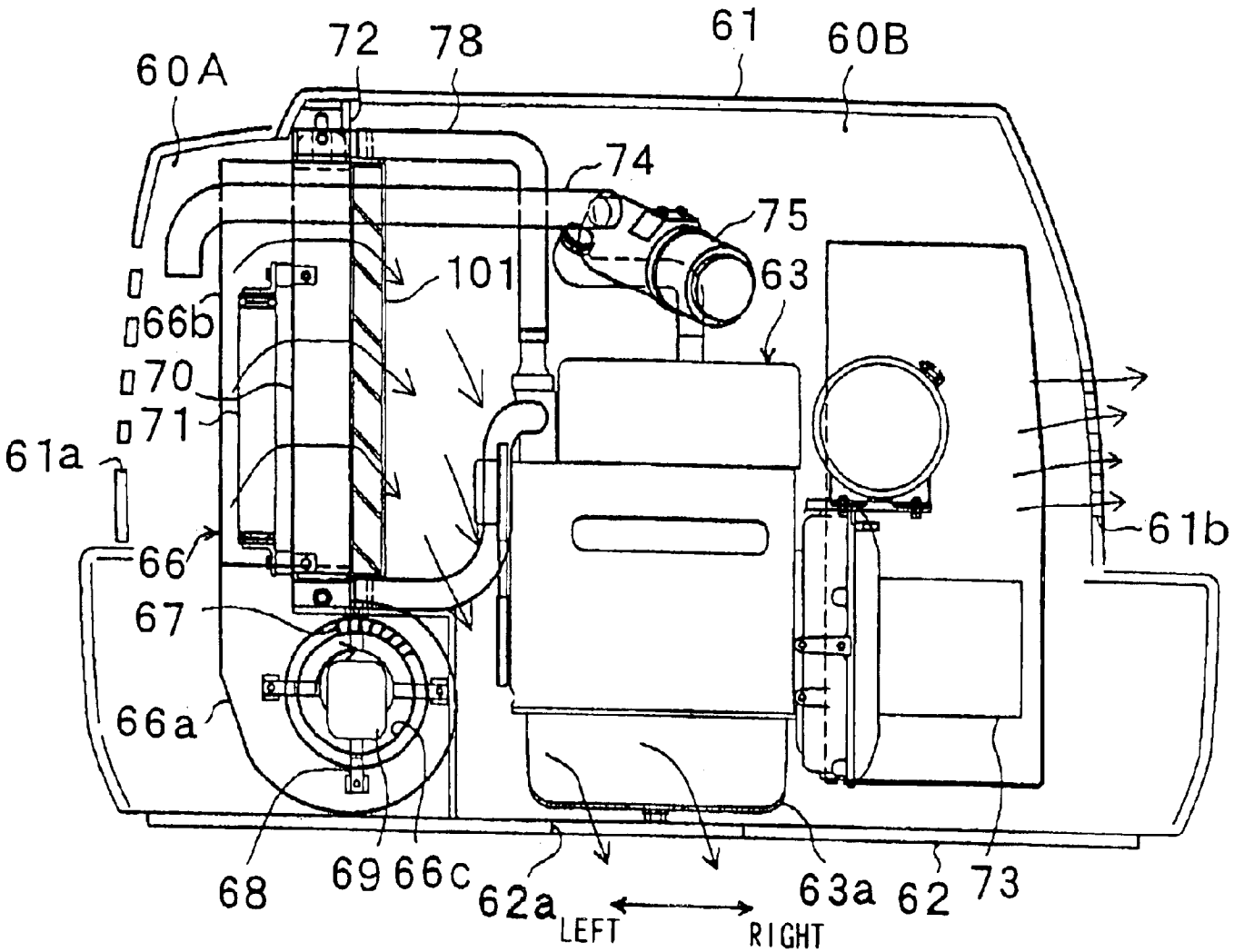
FIG. 20 is a cross sectional drawing showing arrangement of an engine unit of a seventh embodiment of the present invention.

FIG. 20 is a cross section of an engine unit 55 of the seventh embodiment in a widthwise direction of the machine. Points that are the same as in FIG. 12 have the same reference numerals, and the following description will focus on points of difference. As shown in FIG. 20, a straightening vane 101 for directing cooling air that has passed through the radiator 70 in a specified direction (sloping downwards in the drawing) is provided on a right side of the radiator 70.

In this way, cooling air that has passed through the oil cooler 71 is not discharged in that direction but is discharged towards a lower section of the engine 63 making it possible to efficiently cool an oil pan 63*a* etc, in the engine lower section. Noise radiated from the engine 63 by the straightening vane 101 is reflected, which means that it is possible to reduce noise.

In the fourth to seventh embodiments, it is also possible for the arrangement of the engine 63 and the sirocco fan 67, oil cooler 71 and radiator 70 to be reversed laterally.

With the above described embodiments, description has been given by giving an example of a swing type hydraulic excavator having an operating unit 3, 54 that is attached to a front side of the upper swiveling body 2, 52 and that is capable of swinging in the left and right directions, but the present invention is not thus limited. For example, it is also possible to apply the present invention to an offset type hydraulic excavator that has an operating unit arm and bucket moving in parallel in the left and right directions. It is also possible to apply the present invention to a general hydraulic excavator that is not provided with a swing mechanism or offset mechanism.

With the above-described embodiments, descriptions have been given of cases applying both a radiator 20, 70 and an oil cooler 21, 71 as heat exchangers. However, the present invention is not thus limited, and it is also possible, for example, to apply to a structure with only one of either the radiator 20, 70 or the oil cooler 21, 71. It is also possible to similarly apply other heat exchangers (for example, a condenser or intercooler) besides the radiator 20, 70 and the oil cooler 21, 71.

With the above described embodiments, descriptions have been given using examples of the case applied to a hydraulic excavator provided with a canopy 23 covering the upper side of the driver's seat 7, but the present invention is not thus limited and can also be applied to a hydraulic excavator provided with a cab box for covering around the driver's seat 7.

INDUSTRIAL APPLICABILITY

Descriptions have been given above with a tracked hydraulic excavator, particularly a mini excavator, as an example of a construction machine. However, the present invention can also be similarly applied to other construction machines such as medium and large sized hydraulic excavators, wheel type hydraulic excavators, hydraulic cranes, wheel loaders, bulldozers, etc.

What is claimed is:

1. A construction machine, comprising, in a compartment formed by a cover, an engine, a centrifugal fan, and a heat exchanger for exchanging heat between cooling air blown by the centrifugal fan and a predetermined medium, and an operator's seat section that is offset to one side in a widthwise direction of the machine, wherein:

the heat exchanger is arranged at an upstream side of the engine with respect to flow of cooling air and the centrifugal fan is arranged on an upstream side of the heat exchanger, so that cooling air sucked in by the centrifugal fan is led to the engine side after passing through the heat exchanger;

the engine is provided behind the operator's seat section and at an operator's-seat-side in the widthwise direction of the machine, and the centrifugal fan is arranged to the opposite side of the engine with reference to the widthwise direction of the machine.

2. The construction machine according to claim 1, wherein:

a rotational shaft of the centrifugal fan is arranged substantially horizontally, and the centrifugal fan is arranged above the heat exchanger, with a duct for directing cooling air from the centrifugal fan to the heat exchanger.

3. The construction machine according to claim 1, wherein:

the centrifugal fan is arranged to an upper part of the compartment, and a cooling air intake port is provided at an upper part of the cover.

4. The construction machine according to claim 1, wherein:

a rotational shaft of the centrifugal fan is provided substantially in a widthwise direction of the machine.

5. The construction machine according to claim 4, wherein:

an exhaust port for the cooling air is provided below the engine.

6. The construction machine according to claim 1, wherein:

a hydraulic pump driven by the engine is arranged in the compartment and at a centrifugal-fan-side in the widthwise direction of the machine.

7. The construction machine according to claim 6, wherein:

at least one of a hydraulic fluid reservoir for storing hydraulic fluid, and a control valve for controlling flow of hydraulic fluid from the hydraulic pump to an actuator, is arranged in the compartment and at a centrifugal-fan-side in the widthwise direction of the machine.

8. The construction machine according to claim 1, wherein:

at least one of a hydraulic fluid reservoir for storing hydraulic fluid, and a control valve for controlling flow of hydraulic fluid from a hydraulic pump to an actuator, is arranged in the compartment and at a centrifugal-fan-side in the widthwise direction of the machine.

9. The construction machine according to claim 8, further comprising:

a duct for guiding cooling air from the centrifugal fan to the heat exchanger, wherein the duct is arranged adjacent to the hydraulic fluid reservoir.

10. The construction machine according to claim 1, wherein:

a rotational shaft of the centrifugal fan is arranged substantially horizontally, and the heat exchanger is arranged above the centrifugal fan, with a duct for directing cooling air from the centrifugal fan to the heat exchanger.

11. The construction machine according to claim 10, wherein:

the heat exchanger includes an oil cooler and a radiator, the radiator is arranged in an outlet of a duct passage that is formed by the duct, and the oil cooler is arranged substantially vertically with respect to the duct passage at a specified location of the duct passage having a smaller passage area than the outlet of the duct passage.

12. The construction machine according to claim 1, wherein:

the heat exchanger is arranged substantially vertically with respect to flow of cooling air blown from the centrifugal fan.

13. The construction machine according to claim 1, wherein:

the construction machine is a mini excavator.

14. The construction machine according to claim 1, wherein:

the centrifugal fan is a sirocco fan.

15. A construction machine comprising, in a compartment formed by a cover, an engine, a centrifugal fan, and a heat exchanger for exchanging heat between cooling air blown by the centrifugal fan and a predetermined medium, wherein:

the heat exchanger is arranged at an upstream side of the engine with respect to flow of cooling air and the centrifugal fan is arranged on an upstream side of the heat exhanger, so that cooling air sucked in by the centrifugal fan is led to the engine side after passing through the heat exchanger;

a rotational shaft of the centrifugal fan is arranged substantially vertically with respect to a horizon, and the heat exchanger is arranged to a side of the centrifugal fan, with a duct for guiding cooling air from the centrifugal fan to the heat exchanger.

16. A construction machine comprising, in a compartment formed by a cover, an engine, a centrifugal fan, and a heat exchanger for exchanging heat between cooling air blown by the centrifugal fan and a predetermined medium, wherein:

the heat exchanger is arranged at an upstream side of the engine with respect to flow of cooling air and the centrifugal fan is arranged on an upstream side of the heat exhanger, so that cooling air sucked in by the centrifugal fan is led to the engine side after passing through the heat exchanger;

a straightening vane is provided directly downstream of the heat exchanger with respect to the flow of cooling air, to change a flow of cooling air that has passed through the heat exchanger to a specified direction.

17. A construction machine, comprising, in a compartment formed by a cover, an engine, a centrifugal fan, and a heat exchanger for exchanging heat between cooling air blown by the centrifugal fan and a predetermined medium, wherein:

the heat exchanger is arranged at an upstream side of the engine with respect to flow of cooling air and the centrifugal fan is arranged on an upstream side of the heat exhanger, so that cooling air sucked in by the centrifugal fan is led to the engine side after passing through the heat exchanger;

a rotational shaft of the centrifugal fan is arranged substantially horizontally;

the heat exchanger is arranged above the centrifugal fan, with a duct for directing cooling air from the centrifugal fan to the heat exchanger; and a straightening vane is provided directly downstream of the heat exchanger with respect to the flow of cooling air, to change a flow of cooling air that has passed through the heat exchanger to a specified direction.

* * * * *